US011643855B2

(12) United States Patent
Och et al.

(10) Patent No.: US 11,643,855 B2
(45) Date of Patent: May 9, 2023

(54) DOOR HANDLE FOR VEHICLE

(71) Applicant: ILLINOIS TOOL WORKS INC., Glenview, IL (US)

(72) Inventors: Roland Och, Rottendorf (DE); Zsolt Wilke, Bad Mergentheim (DE); Matthias Seubert, Giebelstadt (DE); Joachim Oberst, Grossrinderfield (DE)

(73) Assignee: Illinois Tool Works Inc., Glenview, IL (US)

( * ) Notice: Subject to any disclaimer, the term of this patent is extended or adjusted under 35 U.S.C. 154(b) by 1284 days.

(21) Appl. No.: 15/763,928

(22) PCT Filed: Oct. 20, 2016

(86) PCT No.: PCT/US2016/057851
§ 371 (c)(1),
(2) Date: Mar. 28, 2018

(87) PCT Pub. No.: WO2017/070307
PCT Pub. Date: Apr. 27, 2017

(65) Prior Publication Data

US 2018/0274271 A1 Sep. 27, 2018

(30) Foreign Application Priority Data

| | | |
|---|---|---|
| Oct. 21, 2015 | (EP) | 15401105 |
| Nov. 18, 2015 | (EP) | 15401119 |
| Dec. 18, 2015 | (EP) | 15201442 |

(51) Int. Cl.

| | |
|---|---|
| ***E05B 77/06*** | (2014.01) |
| ***E05B 81/04*** | (2014.01) |
| ***E05B 85/10*** | (2014.01) |

(52) U.S. Cl.
CPC ..... *E05B 85/107* (2013.01); *E05B 77/06* (2013.01); *E05B 81/04* (2013.01); *E05B 85/103* (2013.01)

(58) Field of Classification Search
CPC ..... E05B 85/107; E05B 77/06; E05B 81/04; E05B 85/103; E05B 79/06
See application file for complete search history.

(56) References Cited

U.S. PATENT DOCUMENTS

| | | | |
|---|---|---|---|
| 5,123,687 | A | 6/1992 | Pfeiffer |
| 6,371,538 | B1 | 4/2002 | Inoue |

(Continued)

FOREIGN PATENT DOCUMENTS

| | | | |
|---|---|---|---|
| CN | 1253606 | A | 5/2000 |
| CN | 1982107 | B | 6/2007 |

(Continued)

OTHER PUBLICATIONS

PCT, International Search Report and Written Opinion, International Application No. PCT/US2016/057851; dated Jan. 12, 2017, 11 pages.

*Primary Examiner* — Kristina R Fulton
*Assistant Examiner* — Thomas L Neubauer
(74) *Attorney, Agent, or Firm* — Thompson Hine LLP

(57) ABSTRACT

Door handle assembly for a vehicle has a handle (10) mounted on a handle support (60) and one or more rest positions and at least one release position. The assembly has at least three different positions, —a flush or retracted position, in which the handle (10) is flush or retracted with respect to an outer door surface, —a deployed position, in which the handle (10) protrudes or protrudes to a greater extent than in the retracted position, —and the at least one release position. The handle (10) is connected to the handle support (60) via two links (21, 22) and rotational joints wherein one joint (22.1) also has a translational degree of (Continued)

Figure 1A:
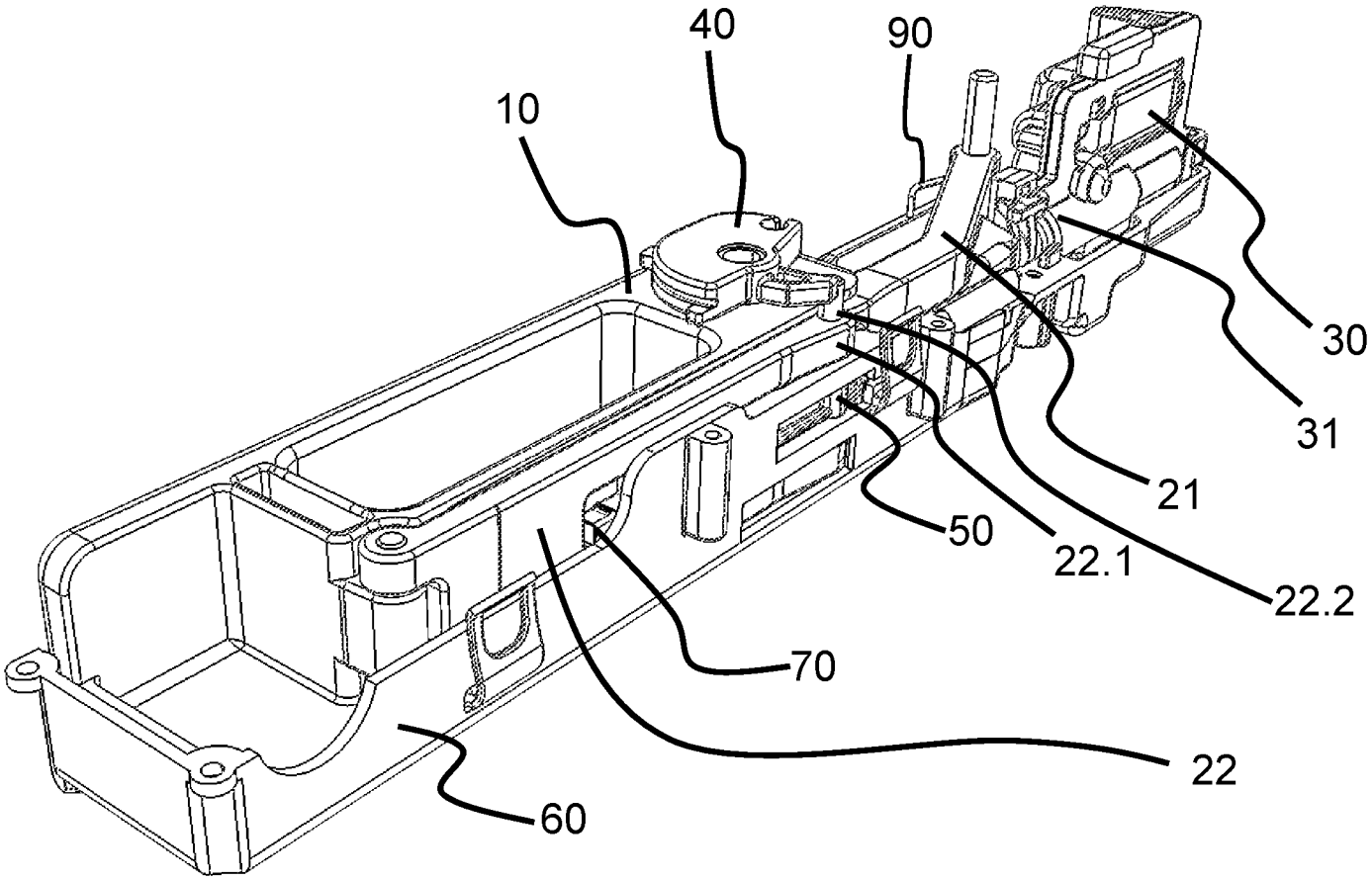

freedom wherein a movement of the joint (22.1) along the translational degree of freedom is configured to mechanically actuate the door lock (120) or door lock (120) function.

16 Claims, 35 Drawing Sheets

(56) References Cited

U.S. PATENT DOCUMENTS

| | | | | |
|---|---|---|---|---|
| 8,985,648 | B2 | 3/2015 | Muller | |
| 10,550,611 | B2 * | 2/2020 | Och | E05B 85/107 |
| 10,907,387 | B2 * | 2/2021 | Och | E05B 81/78 |
| 2006/0061133 | A1 | 3/2006 | Sawajiri | |
| 2007/0152473 | A1 | 7/2007 | Lechkun | |
| 2008/0203737 | A1 | 8/2008 | Tomaszewski | |
| 2009/0039671 | A1 | 2/2009 | Thomas | |
| 2009/0085360 | A1 | 4/2009 | Bertolotti | |
| 2010/0301618 | A1 | 12/2010 | Costigan | |
| 2011/0012375 | A1 | 1/2011 | Graute | |
| 2011/0144868 | A1 | 6/2011 | Tezak | |
| 2011/0154740 | A1 | 6/2011 | Matsumoto | |
| 2012/0074716 | A1 | 3/2012 | Bejune | |
| 2012/0167296 | A1 | 8/2012 | Muller | |
| 2012/0205923 | A1 | 8/2012 | Muller | |
| 2012/0205924 | A1 | 8/2012 | Muller | |
| 2012/0205925 | A1 | 8/2012 | Muller | |
| 2013/0134723 | A1 | 5/2013 | Yokoyama | |
| 2014/0000167 | A1 | 1/2014 | Patel | |
| 2014/0047877 | A1 | 2/2014 | Bohm | |
| 2014/0265372 | A1 | 9/2014 | Smart | |
| 2015/0233153 | A1 | 8/2015 | Smart | |
| 2016/0298366 | A1 | 10/2016 | Och | |

FOREIGN PATENT DOCUMENTS

| | | | |
|---|---|---|---|
| CN | 101180442 | A | 5/2008 |
| CN | 101184900 | A | 5/2008 |
| CN | 101363290 | A | 2/2009 |
| CN | 101426994 | A | 5/2009 |
| CN | 101899931 | A | 12/2010 |
| CN | 101983273 | A | 3/2011 |
| CN | 102108813 | A | 6/2011 |
| CN | 102575486 | A | 7/2012 |
| CN | 102575487 | A | 7/2012 |
| CN | 102597392 | A | 7/2012 |
| CN | 202391218 | U | 8/2012 |
| CN | 103132782 | A | 6/2013 |
| CN | 103339334 | A | 10/2013 |
| CN | 103526992 | A | 1/2014 |
| CN | 103703202 | A | 4/2014 |
| CN | 104514451 | A | 4/2015 |
| CN | 104812979 | A | 7/2015 |
| CN | 104854289 | A | 8/2015 |
| DE | 4002963 | | 7/1991 |
| DE | 19616226 | A1 | 10/1997 |
| DE | 10044902 | A1 | 4/2002 |
| DE | 10350328 | A1 | 5/2004 |
| DE | 102008019335 | | 10/2008 |
| DE | 102010037070 | | 2/2012 |
| DE | 102011001001 | A1 | 6/2012 |
| DE | 102013212198 | A1 | 1/2014 |
| DE | 102013112706 | A1 | 5/2015 |
| EP | 0398106 | | 11/1990 |
| EP | 2055869 | A1 | 5/2009 |
| EP | 2333207 | A1 | 6/2011 |
| GB | 1024740 | A | 4/1966 |
| JP | H0782933 | A | 3/1995 |
| JP | H 11200670 | A | 7/1999 |
| WO | WO 2015074020 | | 5/2015 |

* cited by examiner

DOOR HANDLE FOR VEHICLE

This invention relates to a door handle assembly for a vehicle, preferably for a side door of a vehicle and preferably to an outer door handle assembly, however it could also be an inner door handle assembly or an assembly having both, inner and outer door handle, or a door handle assembly (inner and/or outer) for a trunk lid. The door handle is preferably connected via a mechanism to a handle support (e.g. handle housing) fixed/fixable to the door. The door handle assembly is preferably forming a strap type handle.

According to one aspect of the invention, the door handle assembly has preferably at least a rest position and one release position, preferably two or more release positions, in which a door lock/door lock function (e.g. unlocking and/or opening) is actuated. In addition to a release position, the handle preferably comprises a press button or pressure or proximity sensor as a further interface to the user. Preferably, in the case of two or more release positions, the amount of handle movement (e.g. rotational and/or translational) to the first release position is less than the amount of handle movement from the first release position to the second release position, i.e. a short stroke to the first release position and a long stroke to the second release position, preferably significantly less, e.g. the length of the handle's trajectory from a rest position to the first release position is smaller than 50%, preferably 25%, or 10% of the length of the trajectory from the first to the second release position. Preferably, the arrival of the handle in a release position triggers an electric signal, e.g. by the handle assembly comprising a switch unit positioned relative to the handle in order to be actuated by its movement into said release position. Preferably, the arrival of the handle in a release position mechanically, preferably strictly mechanically, actuates a door lock, e.g. through a Bowden cable transmission. Especially in the case of two or more release positions, the arrival of the handle in the first release position triggers an electric signal, and preferably the arrival of the handle in another release position (e.g. the second, or last) causes said mechanic actuation. Preferably, an arrival of the handle into one release position triggering is an electric signal and causing said mechanic actuation.

According to another aspect of the invention, the door handle assembly preferably comprises a retaining element configured to define a predetermined threshold of a peak force necessary to bring the handle to the release position or to, in the case of two or more release positions, the second release position, whereby the retaining element releases the handle movement after overcoming the threshold. Hereby a necessary force for bringing the handle to the release position or to, in the case of two or more release positions, the second release position, after overcoming the threshold is lower than the force defined by the threshold—i.e., at first a predetermined force has to be applied to release the handle from the retaining element and then the force for further moving the handle is lower than the predetermined force (whereas the force while further moving the handle can increase again the closer it comes to a release position and it might even exceed the predetermined force for e.g. mechanical releasing the door lock). Preferably, the retaining element is spring loaded or has one or more flexible parts. Preferably, the retaining element comprises a trough or step, into which a pin or protrusion engages, before overcoming the threshold and which the pin or protrusion has to overcome by either, preferably flexibly, bending/displacing the pin and/or the retaining element away from each other.

According to another aspect of the invention, the door handle assembly preferably comprises a locking cylinder preferably below the handle. Alternatively, the locking cylinder is positioned and hidden below one side end of the handle (front end or back end) and becomes visible when the handle is in released position.

According to another aspect of the invention, an electronic unit, e.g. a keyless entry module, is preferably integrated in the handle, e.g. in a hollow space within the handle, preferably at one side end of the handle (front or back end).

According to another aspect of the invention, the door handle assembly preferably comprises an inertia lock. Preferably the inertia lock is configured to prevent the handle to move to the release position, especially to the second release position, in case of a crash, especially side crash. The inertia lock preferably comprises an inertia weight mounted via an axis rotatably from a rest position to a block position and preferably back, the axis preferably being substantially perpendicular with respect to the geometric normal to the door surface (e.g. perpendicular with respect to y-direction in case of a car side door, using the car coordinate system). Preferably, the inertia lock also has a lock element, which could be the inertia weight itself or another separate part, the separate part preferably being in fixed relation to the inertia weight, hence rotatable about the axis. The inertia weight could be in a first variant mounted on the door handle or on a part of the mechanism or in a second variant mounted on another part that in contrast to the handle or mechanism has a fixed position (e.g., the door handle assembly housing/mount). The inertia lock preferably comprises at least one block element providing a block surface opposing the inertia weight, e.g., in the first variant the block element is featured on said part that in contrast to the handle or mechanism has a fixed position and in the second variant the block element is featured on the handle or on the mechanism. In case of a (side) acceleration of the door handle assembly, the inertia weight is, due to its inertia, rotated about the axis from the rest position to the lock position in which the lock element and the at least one block element will engage, if the door handle moves or would move outwards (with respect to the door) due to its inertia. Preferably the inertia weight is forced back to its rest position by a spring. Preferably the inertia lock is configured to provide a locking of the door handle preventing a movement from rest position to one of the release positions (release lock), e.g. the first and/or second position. Particularly preferably, the inertia lock provides multiple lock positions, e.g. a first locking position providing a flush lock and at least one further locking position providing a release lock. Preferably, the inertia lock therefor comprises multiple block elements and the different block elements are engageable by the lock element in different door handle positions. The block elements are preferably spaced from each other along a trajectory defined by the movement of the handle or a part of the mechanism. When the lock element is in its rest position, the block elements can pass the lock element without engagement between the block elements and the lock element, when the lock element is in its block position, at an engagement between the lock element and at least one of the block elements will stop further movement of the door handle.

According to another aspect of the invention, the door handle assembly preferably comprises a Bowden cable actuation unit. Preferably this unit comprises a hook element that is retractable into a recess, e.g. a recess of the housing. The Bowden cable is guided over the recess. For actuating the Bowden cable, the hook element is retracted back into the recess where it hooks the Bowden cable and then with further retraction pulls the Bowden cable. The hook element is preferably fixed to or integrally formed with the door handle or a part of the mechanism. Hereby, a smaller movement of the hook element can be transformed into a greater amount of the pulling of the Bowden cable.

According to another aspect of the invention, the door handle assembly has preferably at least three different positions, a retracted position, in which the door handle is preferably (substantially) flush or retracted with respect to the outer door surface, a deployed position, in which the door handle protrudes or protrudes to a greater extent than in the retracted position and one or more of said release positions. The retracted and deployed position are each preferably comparable to said or representing the rest position.

Preferably, movement of the door handle between retracted and deployed position (in one or both directions) is provided via a drive unit (e.g. motor), preferably the drive unit is actively moving (applying a force to) the handle to the deployed position against a spring and the movement back towards the retracted position is then initiated by the energy stored in the spring. Preferably, the motor is pushing a push rod and/or motor adapter towards a switch, the switch providing a signal for having reached the deployed position. Preferably, in addition, the door handle is also manually movable between deployed and retracted position. Preferably, the one or more release positions are obtained by manual actuation, preferably pulling, of the door handle, starting from the deployed and/or the retracted state.

Said mechanism preferably provides at least two release positions, a first release position in which an electric (e.g. electro-mechanic) switch is switched for electric actuation of the door lock (function) and a second release position, in which preferably the handle is moved and/or rotated with respect to the deployed or retracted position even further than in the first release position and in which another switch, preferably related to another door actuation function, is switched or a mechanic actuation of a door function, e.g. via Bowden-cable, is performed. Preferably, the mechanism is configured to guide the handle movement on an essentially linear trajectory (appearance more like a translational movement than a rotational movement) between the retracted and deployed position, at least when no additional external force is impinging on the handle. The mechanism preferably has two links or hinge arms connecting the handle to a handle mount. One hinge arm may be substituted by a guiding curve onto which the handle is hinged.

Preferably, the drive unit is movable with respect to the handle support, e.g. mounted rotatably with respect to the handle support via a rotation axis. For example, the drive unit is fixed to the door handle or to a part of the mechanism that is movable with respect to the handle support.

Preferably, the handle or some part of the overall handle structure or an adjacent (e.g. within 10 cm, preferably 5 cm of the door handle) part of the door comprise one or more proximity sensors (e.g. capacitive sensor), which are connected to a control unit controlling the movement of the handle. Preferably a part of or the complete activation area of the proximity sensor is visualized by a marking (e.g. groove and/or different color and/or protrusion). The proximity sensor and control unit are preferably configured to retract or deploy the handle when an object (e.g. a hand) comes close enough to the activation area. The activation area may be defined by a sensor value threshold.

In case a locking cylinder is present, the locking cylinder is preferably positioned and hidden below one side end of the handle (front end or back end) and becomes visible when the handle is in deployed and/or released position.

Preferably, the door handle assembly comprises at least two springs. A first spring urging the handle from the deployed to the flush position, and a second spring urging the handle from one or more of the release positions (e.g. second release position) to the deployed position or to another one of the release positions (e.g. first release position). By using two different springs, different restoring forces in different positions of the handle can be defined, e.g. a smaller force when the user is manually moving the handle from the deployed position to the first release position (e.g. electronic actuation) and an higher force when the user is moving the handle from the first release position to the second release position (e.g. mechanic actuation). Preferably the two springs are featured in addition to a spring that might exist within the door lock, pulling the Bowden cable. Preferably, the second spring (directly/indirectly) engages the handle or the mechanism only between and preferably including deployed and one or more of the release positions, particularly preferably only between and preferably including the first and the second release position, preferably excluding the first release position (closer to the deployed position). Hereby, the second spring is applying a restoring force against the handle movement to the second release position and hence, this second spring can be adapted, e.g., especially for the purpose of providing a strong restoring force for a mechanic door actuation, which is beneficial for providing a sufficient crash safety such that the handle's inertia will not unintentionally open the vehicle door. Preferably, the counterforce of the second spring adds up to the restoring force of the first spring, hence the first spring is also applying a restoring force, when the second spring applies a restoring force to the handle's movement, and in addition the first spring is also applying a restoring force, when second spring does not apply a restoring force to the handle's movement.

Preferably, in case said inertia lock is present it is configured to provide a locking of the door handle preventing a movement from flush position to deployed position (flush lock). Preferably, the flush lock also prevents the movement of the door handle to the release position(s). Preferably the inertia lock is configured to provide a locking of the door handle preventing a movement from deployed position to one of the release positions (release lock), e.g. the first and/or second position.

According to another aspect of the invention the door handle assembly preferably comprises an inner door handle and an outer door handle.

According to another aspect of the invention the door handles preferably are coupled to each other and configured to pull on the same Bowden cable leading to the door lock. Hereby, it is not necessary to use two parallel Bowden cables or to reduce the length of parallel running Bowden cables. For example, the inner door handle engages (directly or indirectly) with the Bowden cable at a first engaging section and the outer door handle engages (directly or indirectly) with the Bowden cable at a second, different (e.g., 5 cm apart) engaging section. Depending on the relative position of the two door handles it is also thinkable that they engage (directly or indirectly) with the Bowden cable at substantially the same engaging section. Preferably, at least one of the door handles is mounted or mountable in a vertical window frame part next to a door window (e.g., B-column). Preferably the handles are adjacent to the same corner of the door window, preferably over-corner or even directly opposing each other on the same side of the corner.

Preferably, the assembly comprises a handle decoupling unit decoupling the movement of the handles (partly, in one or more direction or movement sequences) from each other. Hereby one handle can be actuated without moving the other handle, and preferably vice versa, although both handles pull on the same Bowden cable. The handle decoupling unit preferably comprises an elongated whole, in which a pin or nipple directly or indirectly coupled to the Bowden cable is guided. Preferably, the Bowden cable comprises two parts and the handle decoupling unit is connecting both parts to each other.

According to another aspect of the invention the door handle assembly preferably comprises a Bowden cable coupling unit, configured to be switched between two different states wherein in one state the Bowden cable transmission between one door handle or one or both of the door handles (in case of inner and outer door handle) is decoupled and in the other state the Bowden cable transmission between the door handle or one or both of the door handles is coupled. The Bowden cable coupling unit could be close to the door lock or close to the door handle or wherever else in the path of the Bowden cable transmission where there is suitable and available installation space. Hereby, the mechanic door actuation can be easily prevented in a controlled manner. Preferably, the Bowden cable coupling unit comprises an actuator, mechanically rotating and/or shifting an engaging member for shifting between the two different states. It is particularly preferred to couple the two handles to each other (as described before) as due to such coupling, only one actuator in the Bowden cable coupling unit is necessary to provide the desired function. The Bowden cable coupling unit is preferably built up as a separate module.

Examples of such a handle assembly will now be described with reference to the accompanying drawings—even if features mentioned above are not shown or visible in one example, this description also explicitly covers any combination. Throughout the drawings reference numerals are used for identical components or components having a comparable function. Further, for the avoidance of any eventual doubts raising from the conversion from color or grayscale drawings (as in the priority applications) to the black and white line drawings (as in this application), the drawings of the applications, to which this application is claiming priority, shall be used for interpretation if necessary, and to this extent (color/grey information) the drawings of the priority applications are forming part of this application, too.

Figure 1B:
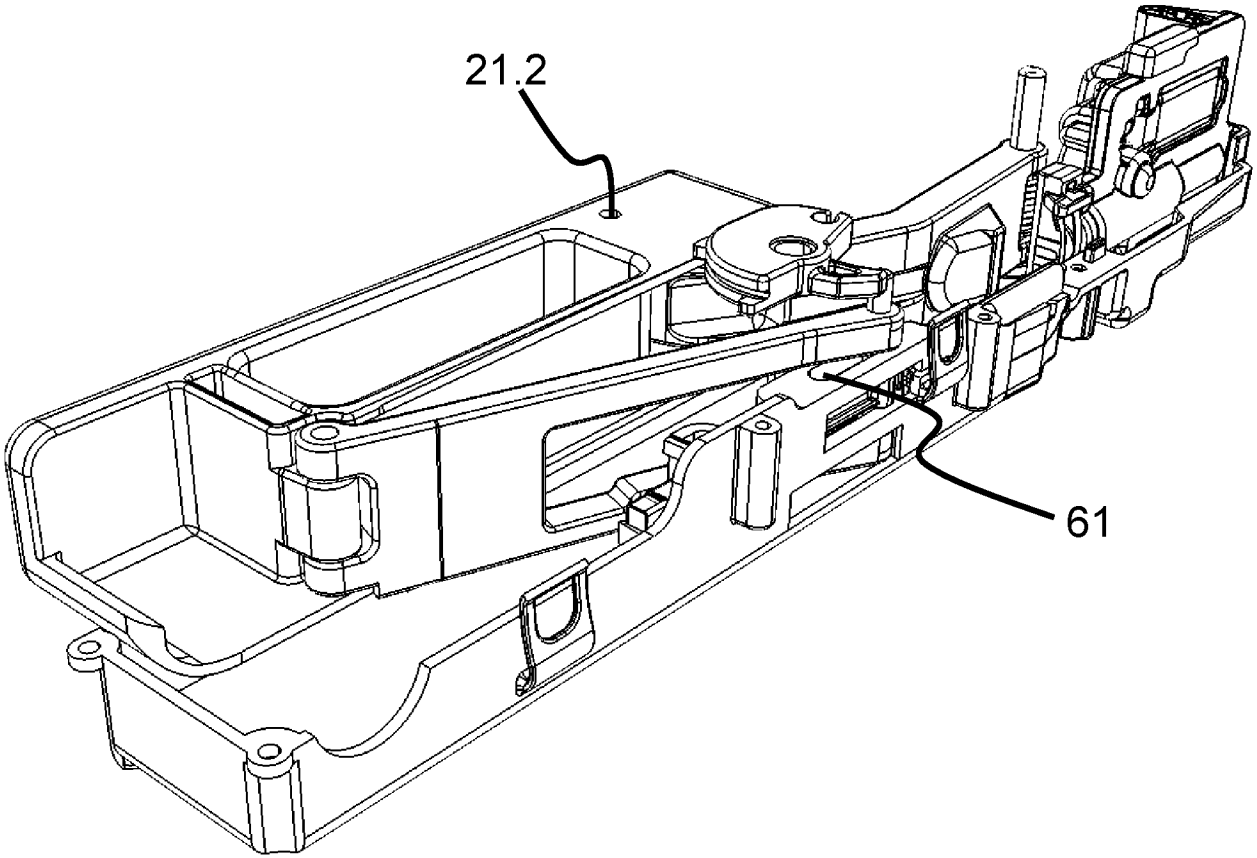
Figure 1C:
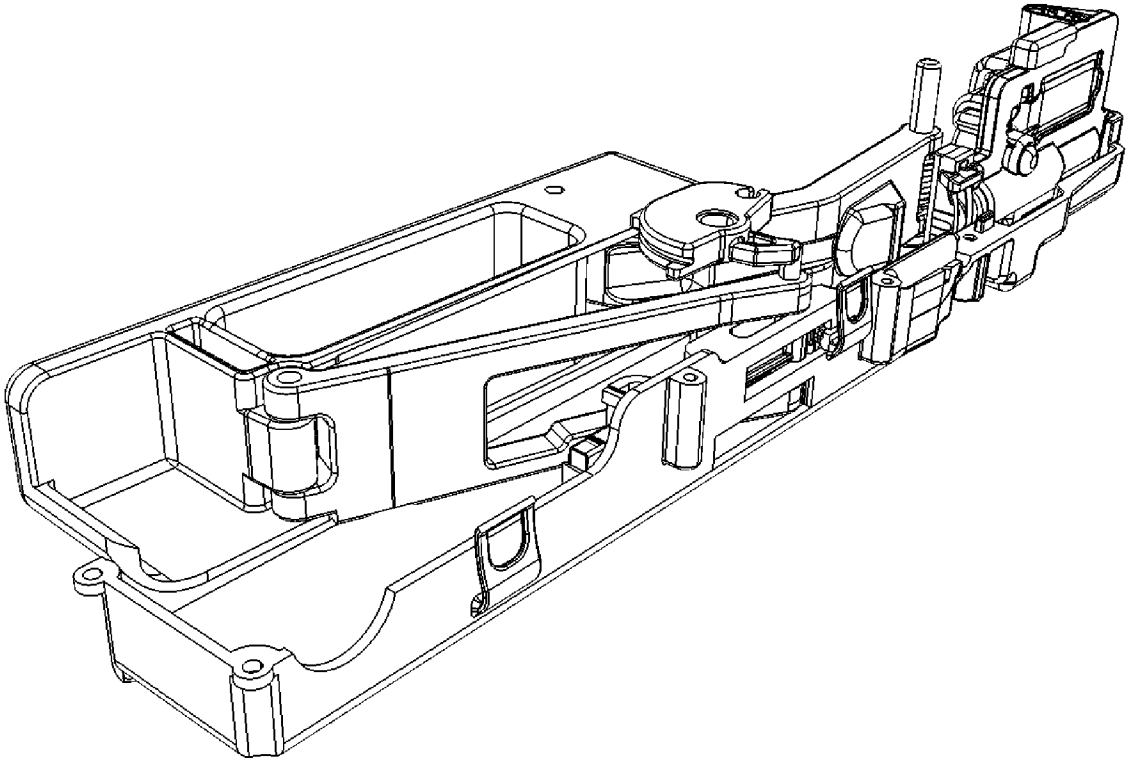
Figure 1D:
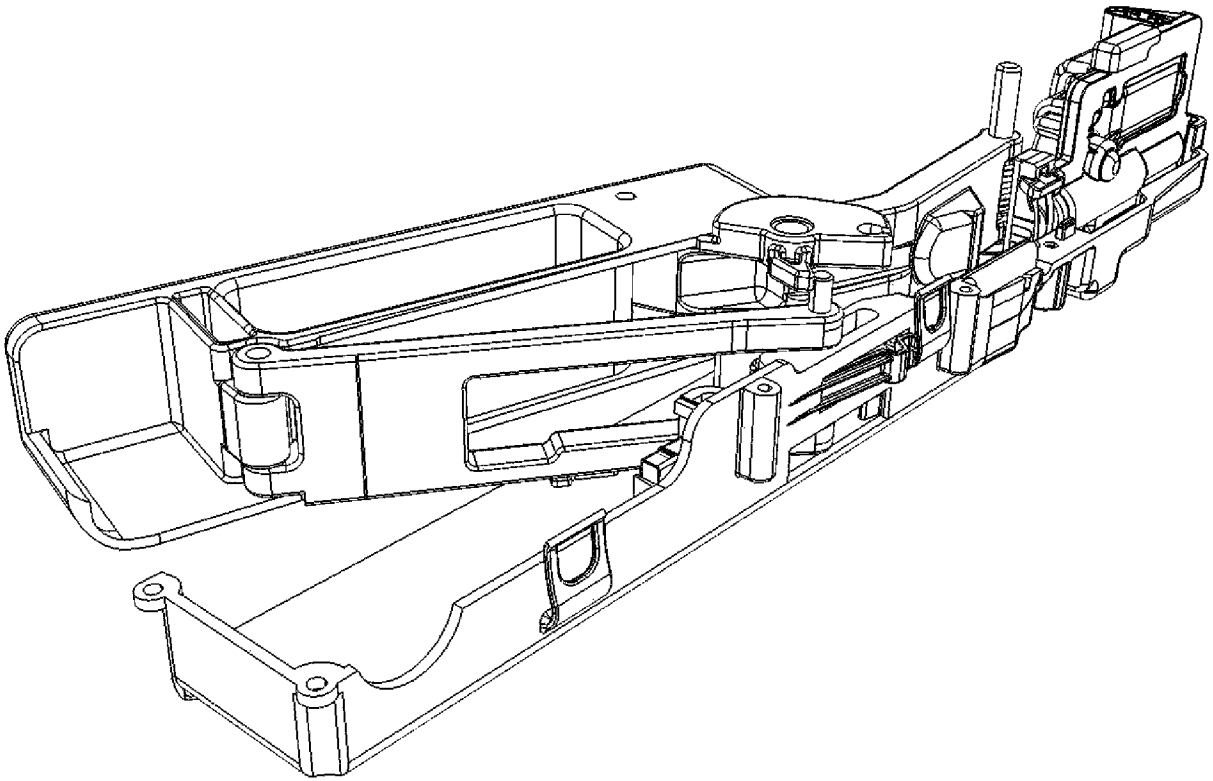
Figure 1E:
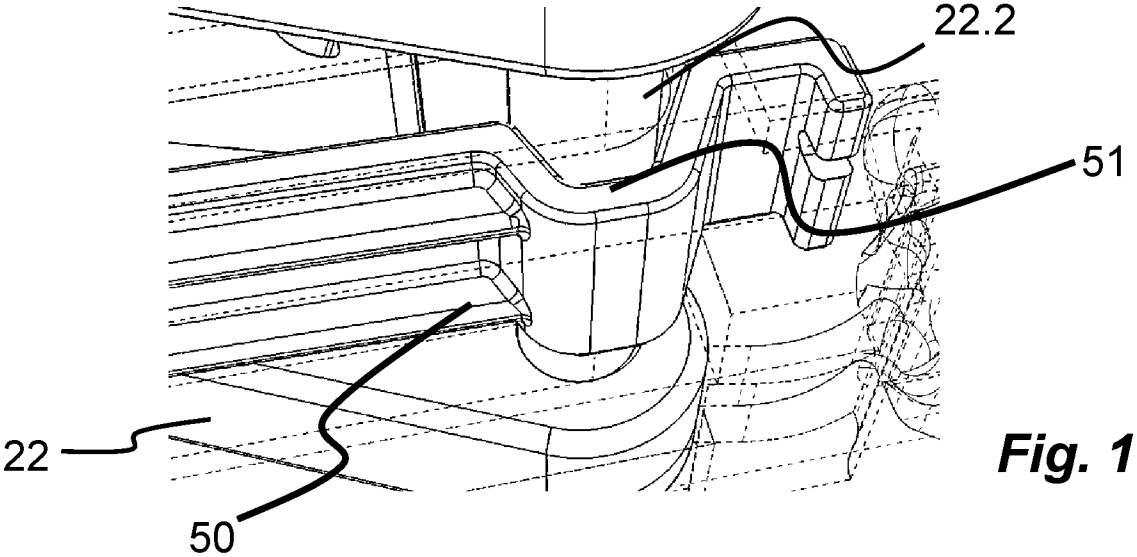
Figure 1F:
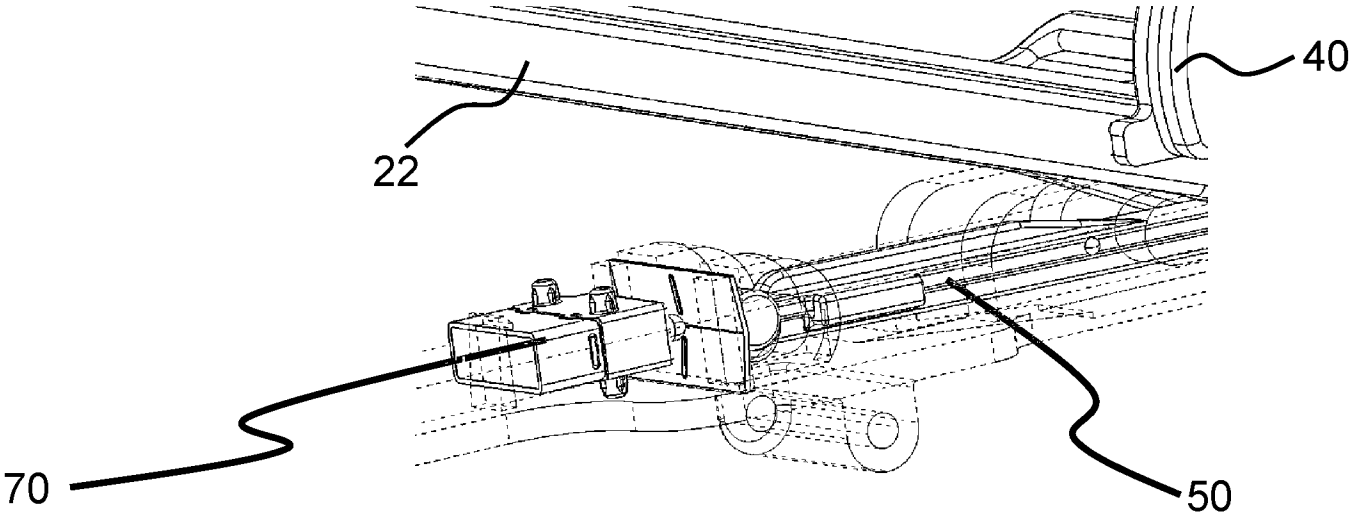

FIG. 1*a*-1*d* show a first embodiment of a door handle assembly with a door handle 10, FIGS. 1*e* and 1*f* a detailed view of one aspect of this embodiment, in particular the retaining element 50.

The handle 10 can be moved from flush or retracted position (FIG. 1*a*) to deployed position (parallel movement), FIG. 1*b*, by the drive unit 30 (and back, e.g. by a counter spring or again the drive unit 30). (In the drawing, the movement of the drive unit is not animated—the drive unit however has a push rod 31 which is extending for moving from flush to deployed position).

From deployed position (but also from flush position—useful in case of emergency), the handle 10 can be further pulled to the first (FIG. 1*c*) and second (FIG. 1*d*) release position, where the door will be opened. A Bowden cable is (in mounted state) fixed to the pivot element 40.

The parallel movement is guided via two parallel linked links 21, 22 or hinge arms 21, 22—a first link 21, which is preferably driven by the drive unit 30, and a second link 22. The first link 21 is connected to the handle 10 via a joint having an axis 21.2. The links 21, 22 are forming a parallelogram, however, with one joint (here joint with axis 22.2) being translatory, such that the parallelogram can be opened (to be not a parallelogram anymore). Preferably, the drive unit 30 engages on one of the links, e.g. via a push rod, here on link 21. A spring is pulling back either link 21 or link 22, preferably link 22. Preferably, the drive unit 30 is mounted on the handle mount 60 via a rotational joint, such that the drive unit 30 has no fixed relation with respect to the handle mount 60 as it is rotatable. Preferably, while the drive unit 30 is moving the door handle 10 (e.g. from retracted to deployed position), the drive unit 30 is moving itself, with respect to the handle mount 60, too, such that the drive unit 30 turns about the rotational joint axis.

The second link is connected to the handle mount 60 via a joint 22.1 having an axis 22.2. This axis 22.2 is supported in a longitudinal recess 61 and linearly movable within this recess 61. The axis 22.2 is retained by a flexibly mounted retaining element 50 in one end position/end position area of the recess 61. In this position of the axis 22.2, the first link 21 and second link 22 are parallel linked, i.e. the hinge arms have substantially the same lengths, i.e. the distance of the joints of each hinge arms have approximately the same lengths.

By pivoting the handle 30 around the axis 21.2, the axis 22.2 engages with the retaining element 50. In FIG. 1*b* and FIG. 1*e*, the retaining element 50 is engaged and ready to activate the microswitch 70 (see below). If the pivot moment exceeds a certain threshold the axis 22.2, the retaining element 50 is bend or moved aside such that the axis 22.2 flips over the retaining element 50 and is free to move towards the other end of the recess 61. Hence, retaining element (50) is thereby disengaged (FIG. 1*d*, showing second release position, i.e. mechanic actuation). By this movement of the axis 22.2, the Bowden cable for releasing the door lock is pulled (here: realized by a pin coaxial to axis 22.2 engaging with the pivot element 40, which is then pulling a Bowden cable to unlatch the door mechanically).

Additionally, this handle offers an electronic actuation of the door lock via a microswitch 70. If the switch is switched, the door lock is actuated electronically—known as e-latch. The switch is actuated in the first release position (FIG. 1*c*).

Preferably the movement of the retaining element 50 actuates the switch 70. Here, the retaining element 50 is movably mounted along the direction of the expansion of the recess 61. The retaining element 50 has a through (cf. FIG. 1*e*) into which axis 22.2 engages, however, when applying a linear force on the axis 22.2, the axis 22.2 may get over the through and become movable within the recess 61. Before overcoming the through, the axis 22.2 pushes the retaining element 50 onto the switch 70 (cf. FIGS. 1*c* and 1*f*, where microswitch 70 is pushed by and engages with the retaining element 50).

Alternatively, the movement of the handle 10 could directly actuate the switch 70, e.g. by the switch 70 being positioned on the mount 60 next to the handle 10, and the handle 10 pushing down the switch 70 in retracted and deployed position into pressed state; only when pulling further, the switch 70 becomes released (=switch action for controlling a door function).

Figure 1G:
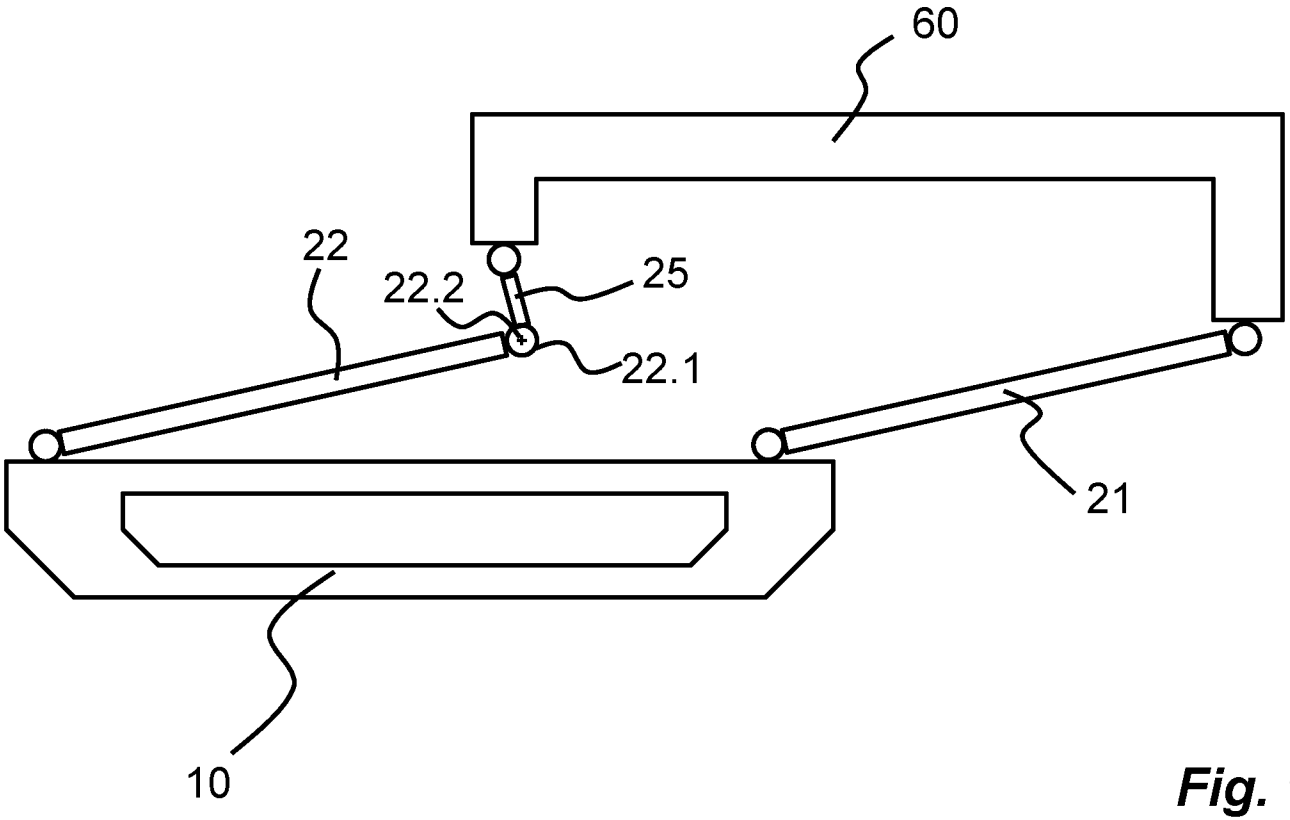

FIG. 1*g* shows a design similar to the one of FIG. 1*a*-1*f* with an alternative for implementing the additional degree of freedom of joint 22.1. The joint 22.1 having the translational degree of freedom comprises an axis 22.2 supported on a pivot arm 25, the pivot arm 25 being pivotally mounted with respect to the handle support 60.

Figure 2B:
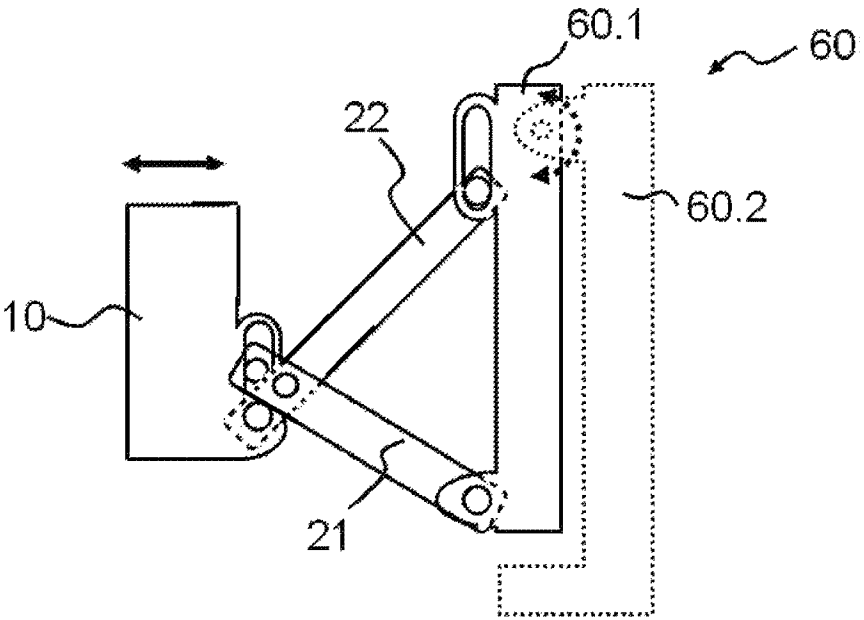
Figure 2A:
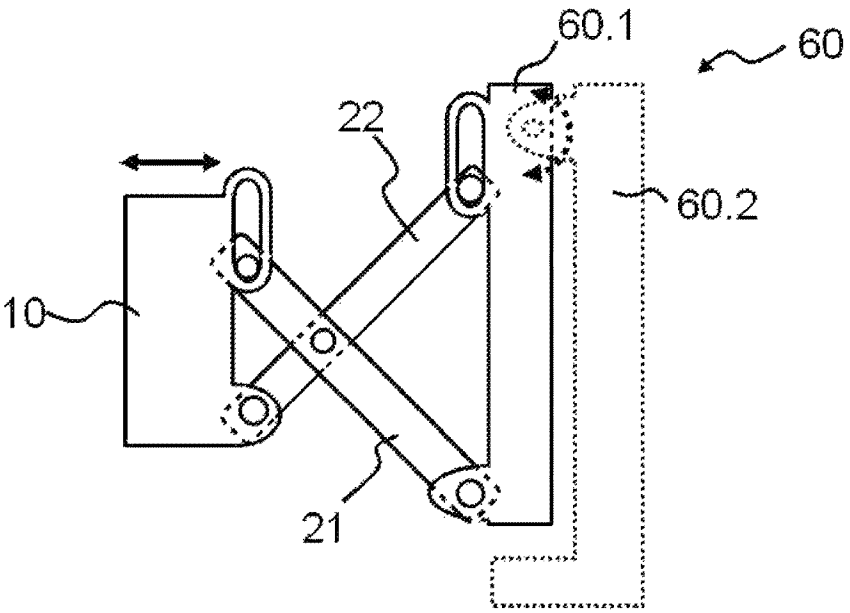
Figure 2C:
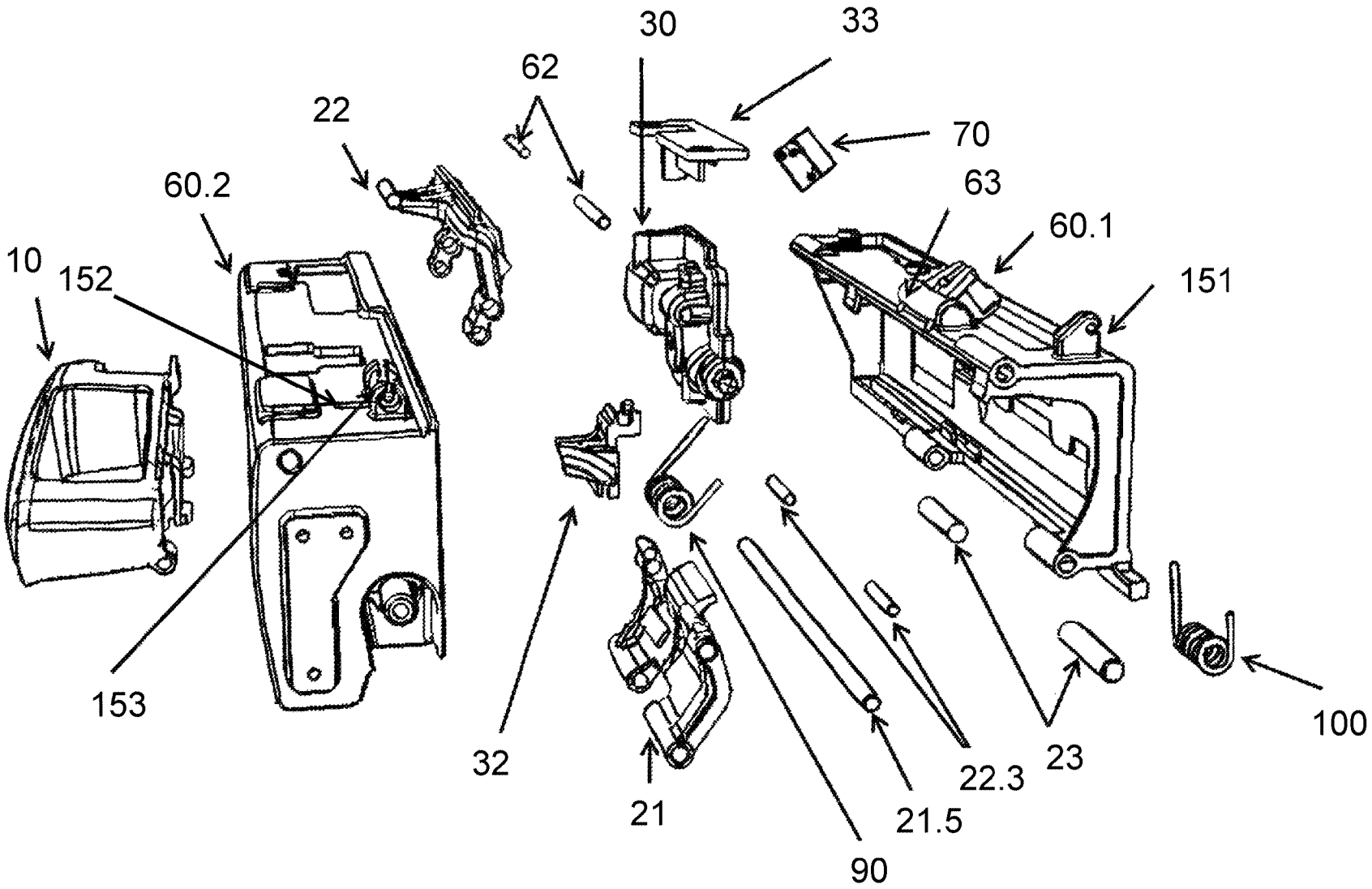
Figure 2D:
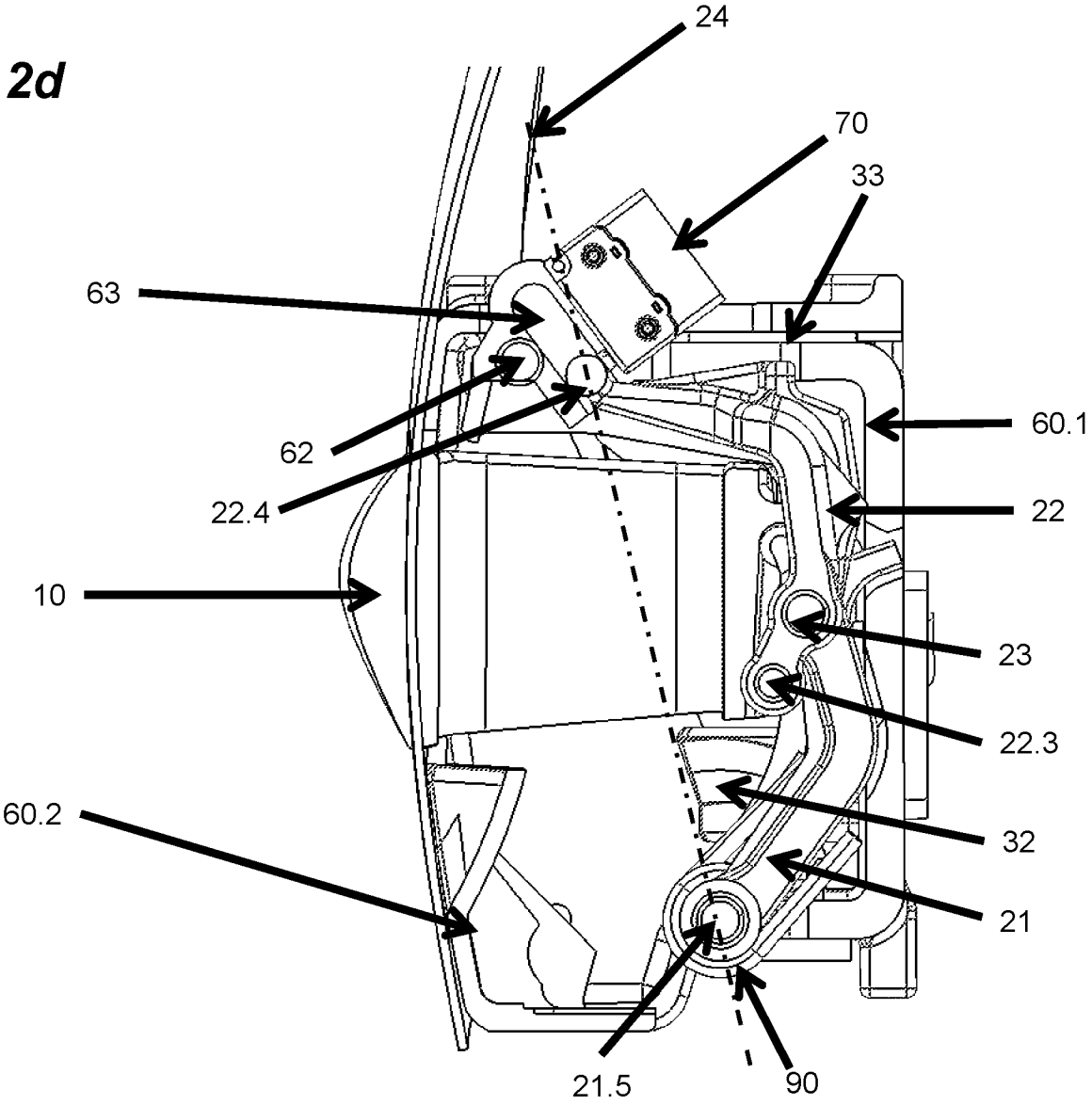
Figure 2E:
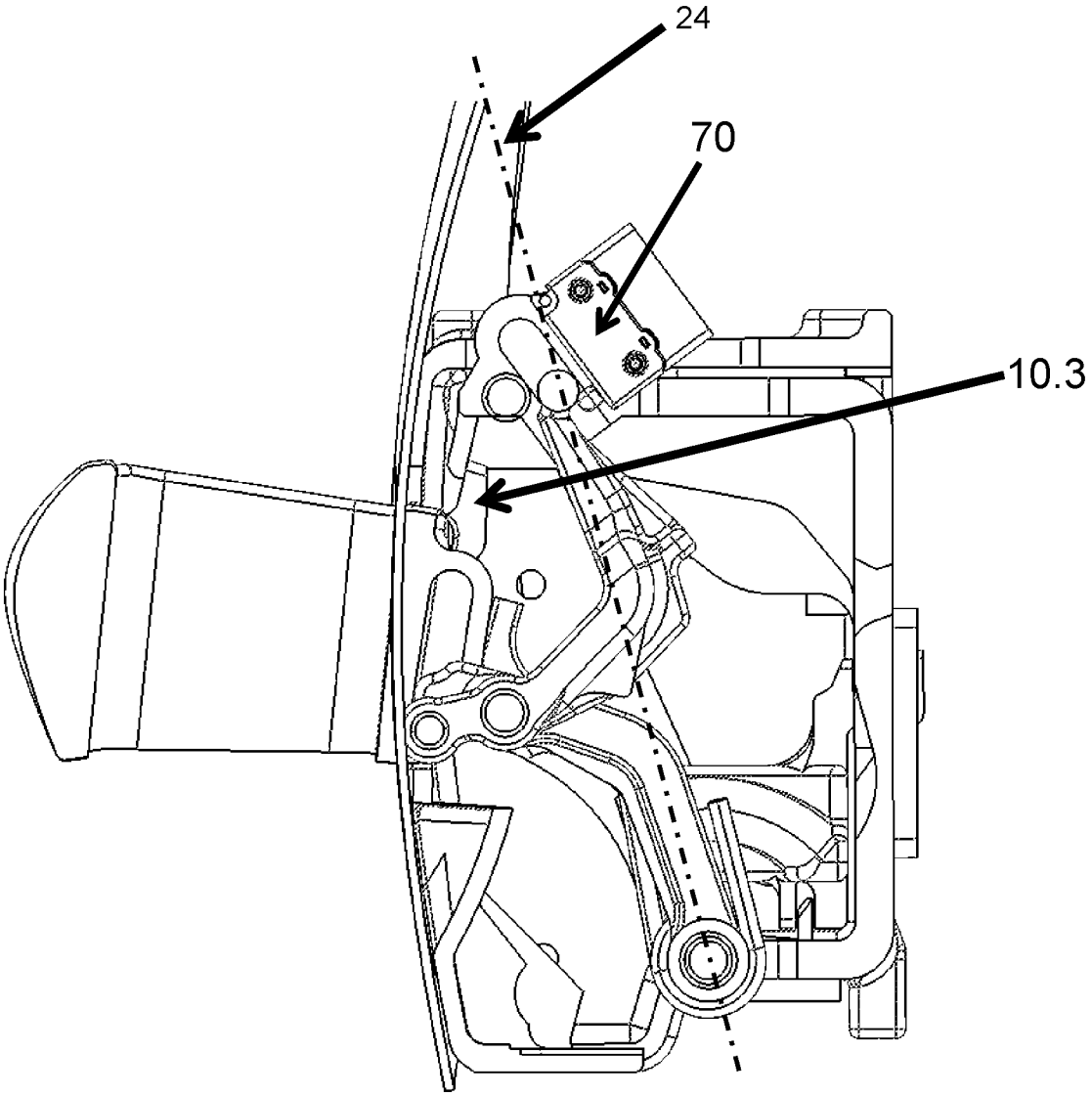
Figure 2F:
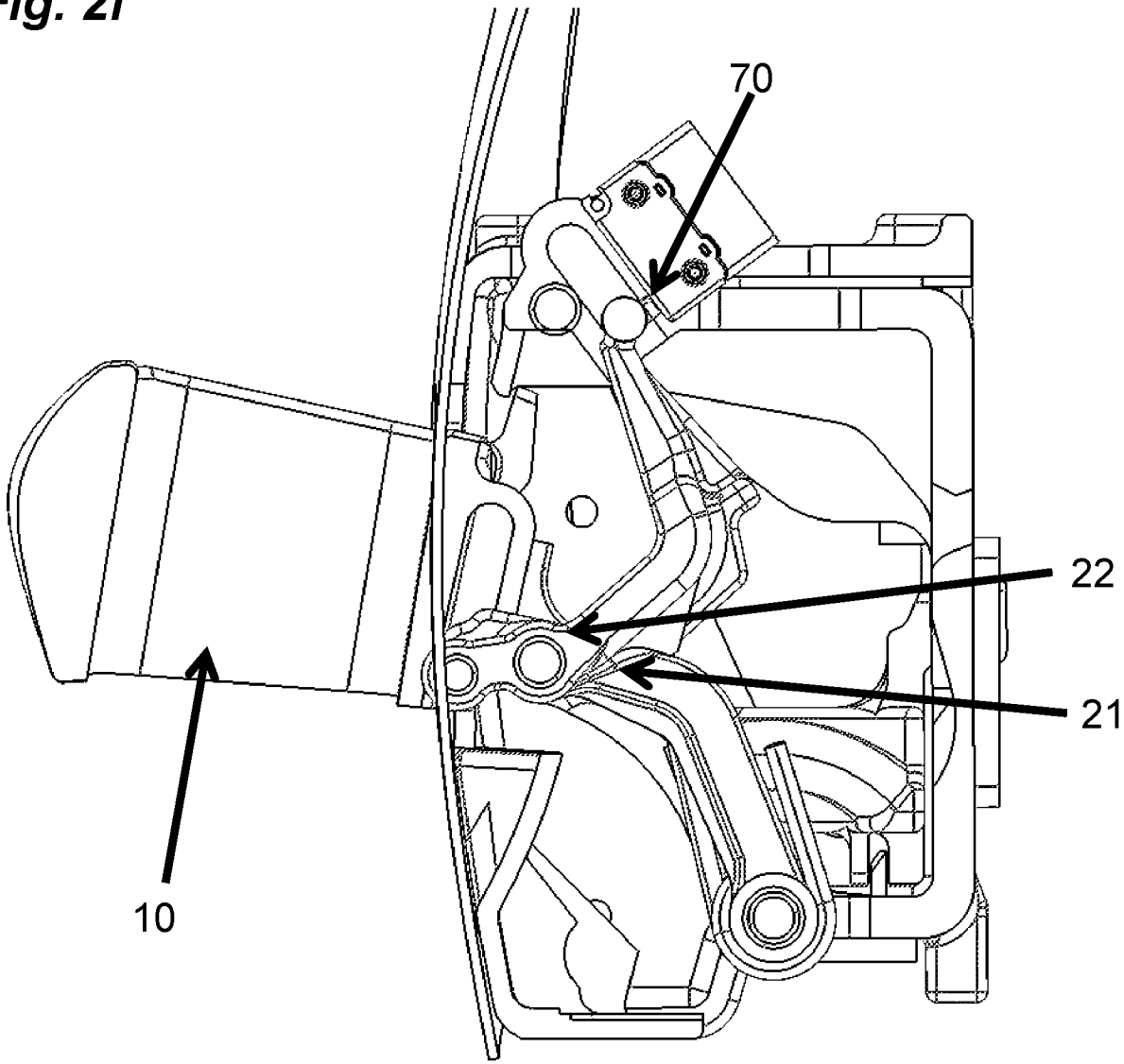
Figure 2G:
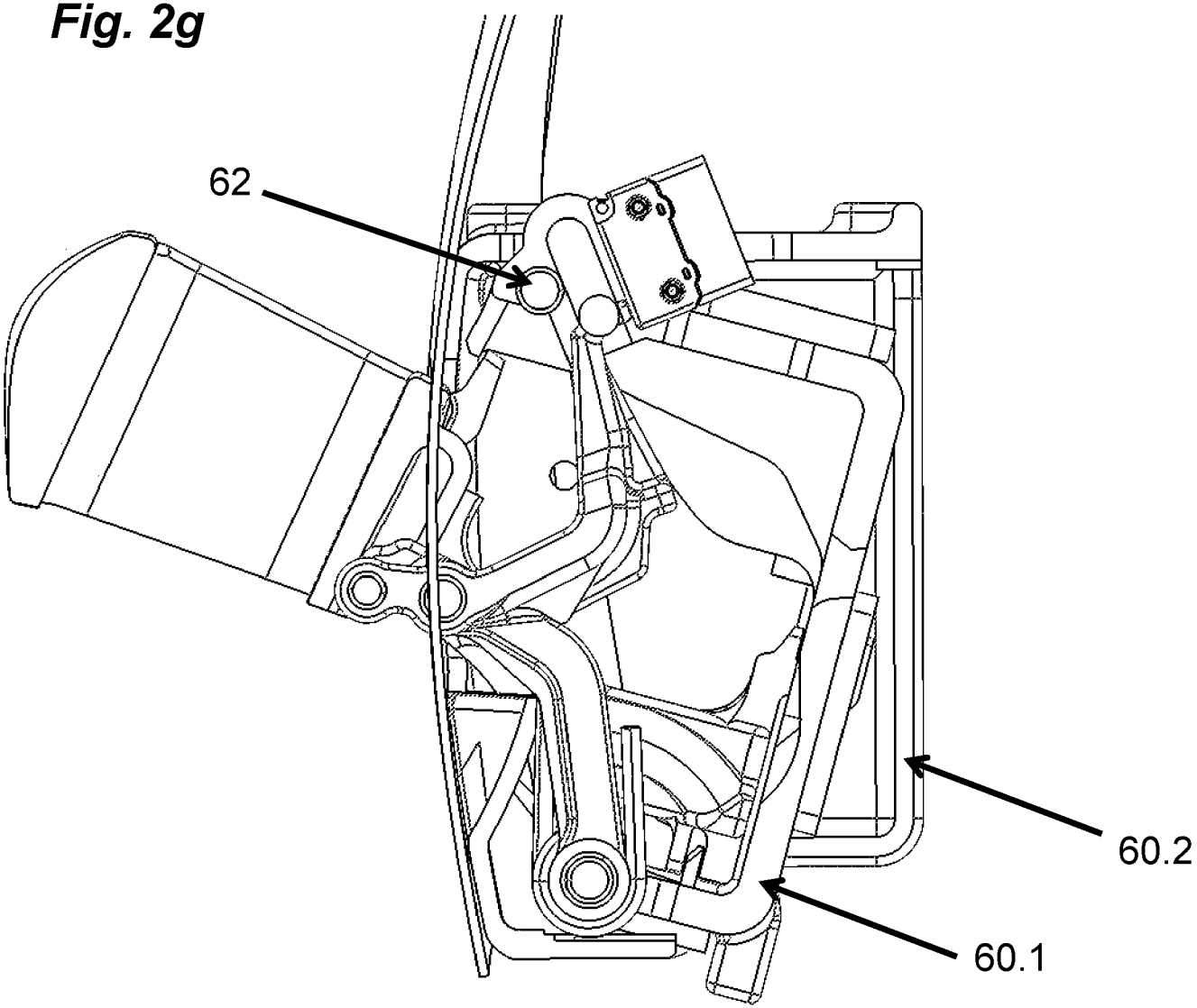
Figure 2H:
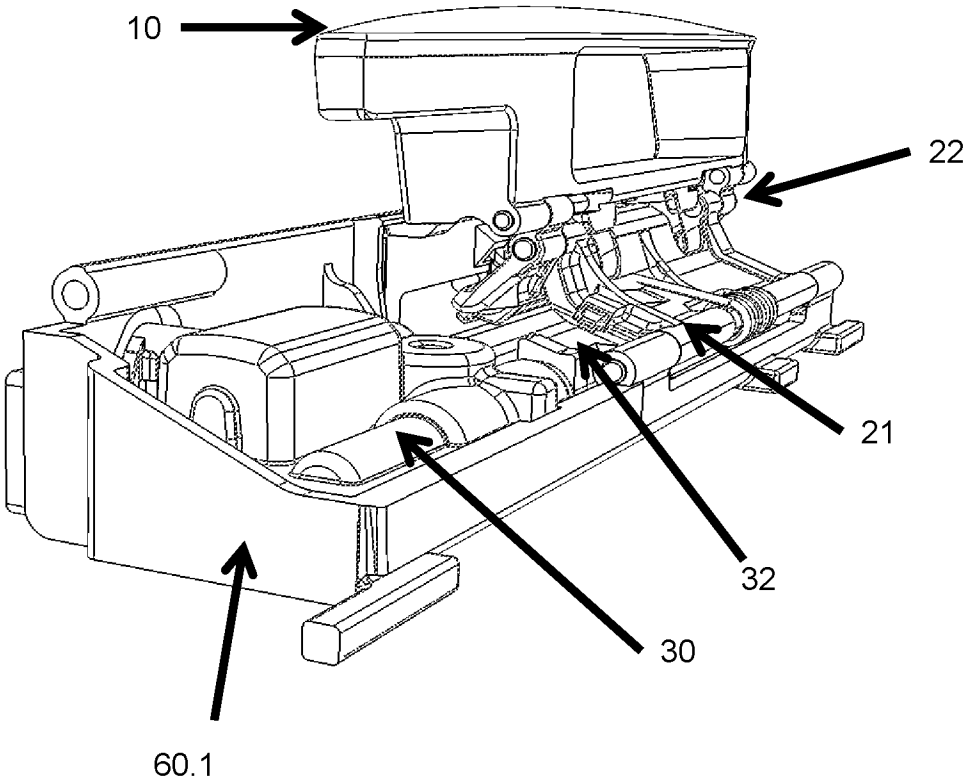
Figure 2I:
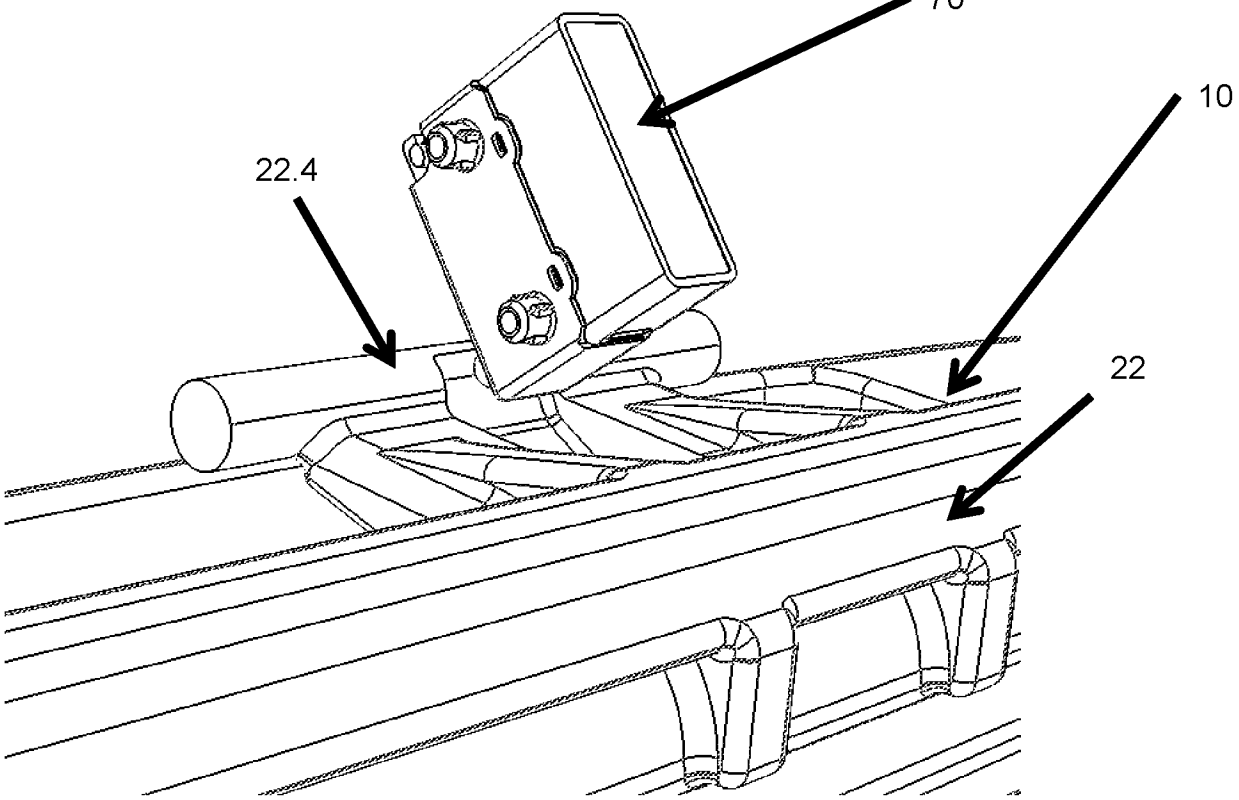
Figure 2J:
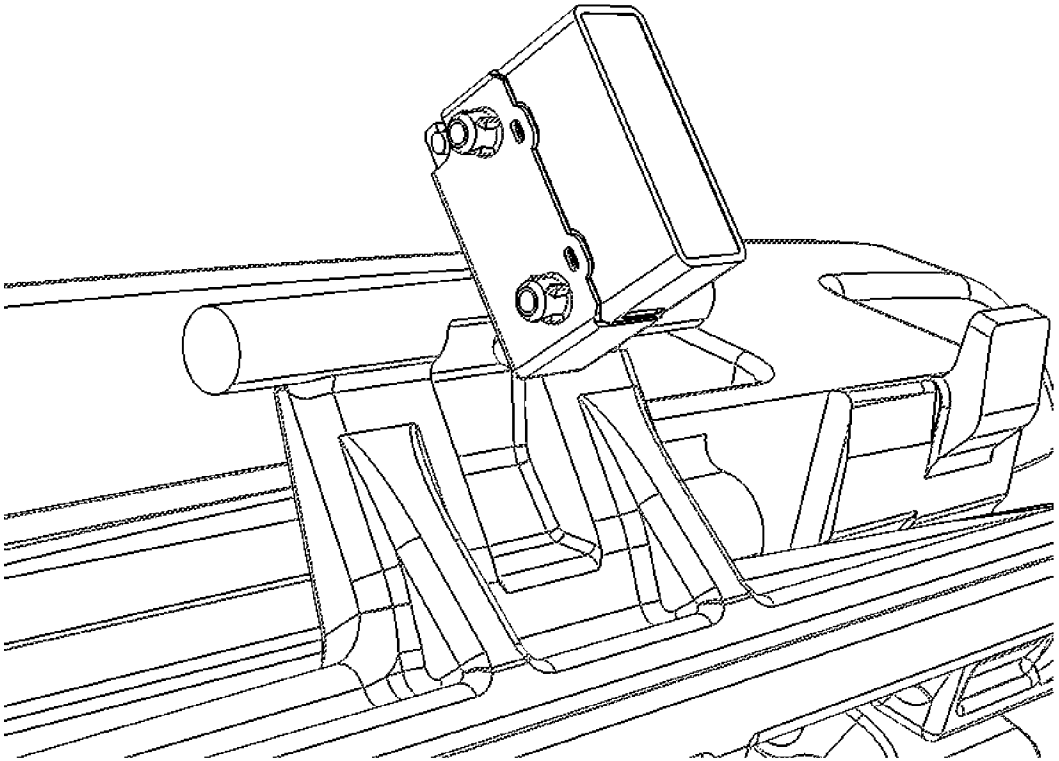
Figure 2K:
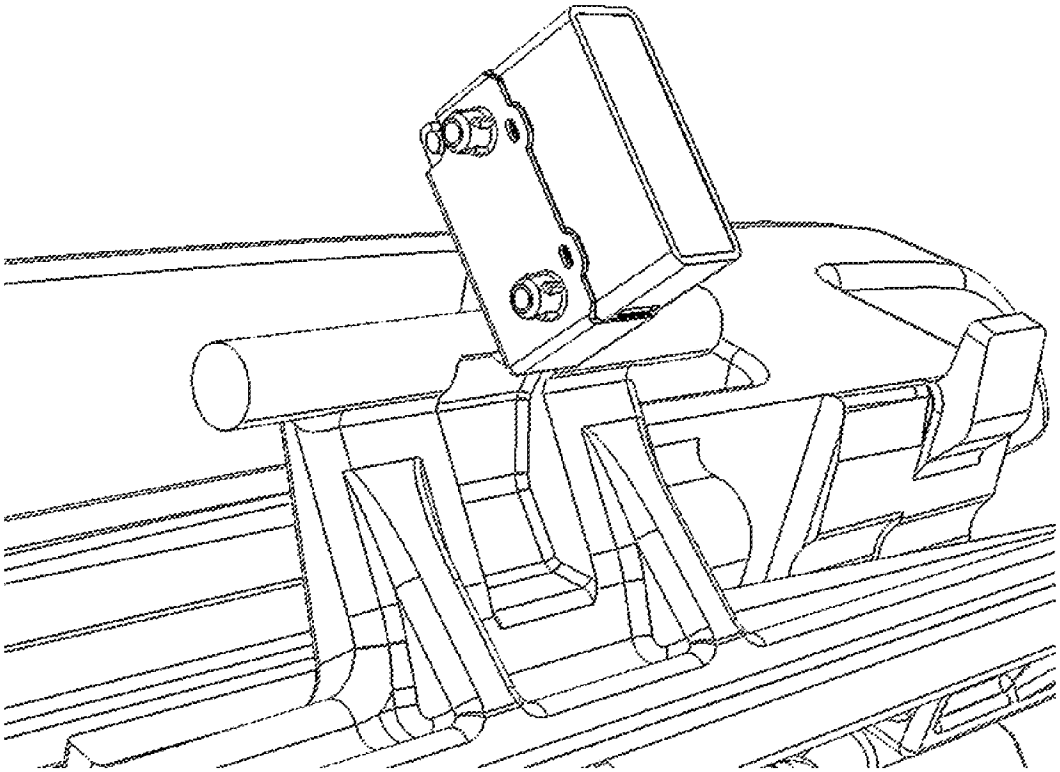
Figure 2I:
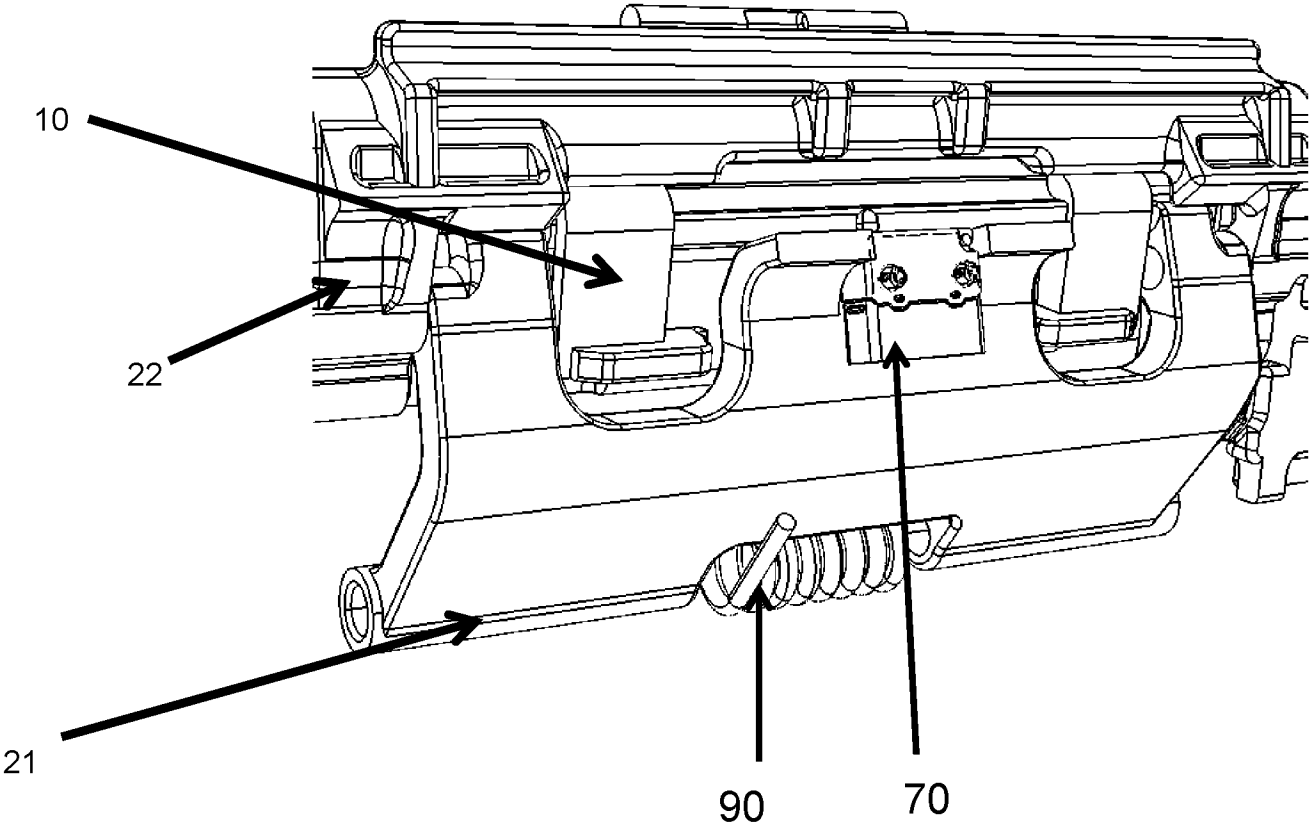
Figure 2M:
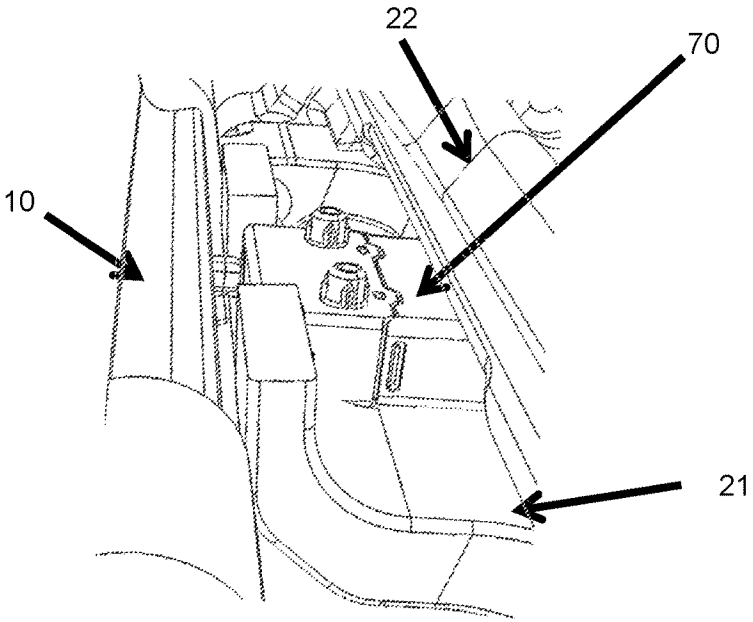
Figure 2N:
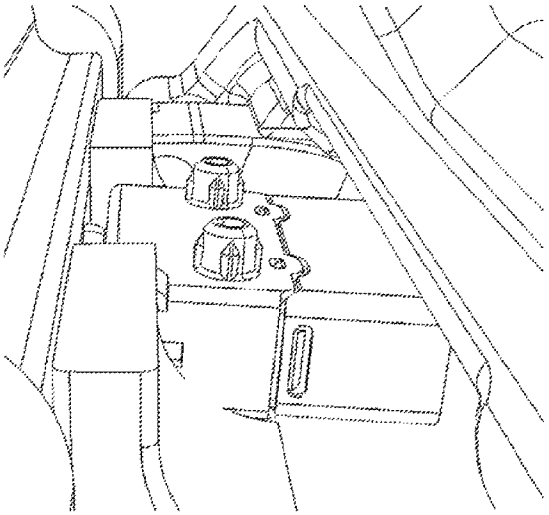
Figures 2O, 2P:
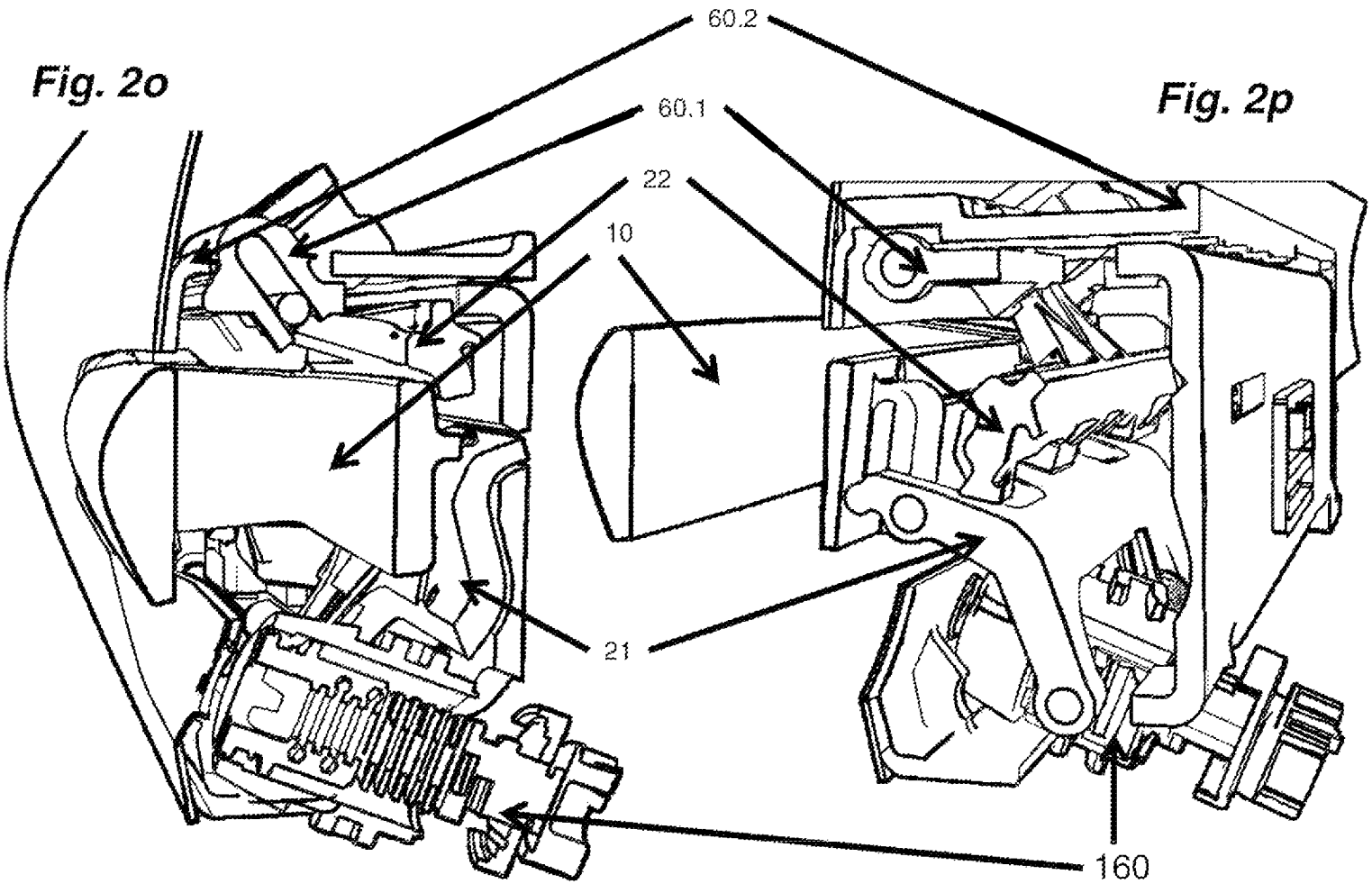

FIG. 2 and all subfigures refer to another embodiment of a door handle assembly, whereas FIG. 2*c* shows an exploded view, FIG. 2*d* flush or retracted position, FIG. 2*e* deploy position, FIG. 2*f* a first, regular release position, FIG. 2*g* a second, emergency, release position, FIG. 2*h* a perspective side view of the assembly in deploy position, FIG. 2*i* a detailed view of microswitch 70 in retracted state, FIG. 2*j* the same as FIG. 2*i* but in deploy state and FIG. 2*k* the same as FIG. 2*j* but in the first, regular, release position, FIG. 2*l* an alternate position of the microswitch 70, in retracted position, FIG. 2*m* the same as FIG. 2*m* but from a different perspective and in deployed position, FIG. 2*n* the same as FIG. 2*n* but in the first release position (where switch 70 is being actuated), FIGS. 2*o* and 2*p* a perspective cross section of the handle cut at different positions, whereby FIG. 2*o* is showing the retracted position and FIG. 2*p* the deployed position. In principle, as shown in FIG. 2*a* and FIG. 2*b*, the handle 10 is connected to the handle mount 60 via two links 21, 22 which are building a pantograph's mechanic or scissors mechanic, i.e. they are crossing each other and at the crossing point they are connected via a joint (axis). On each, handle 10 and mount 60, there is at least one glide joint (here, an elongated hole). The handle is moved between retracted and deployed position via this pantograph's mechanic. Preferably, the handle mount consists of first mount part 60.1 and a second mount part 60.2 and they are rotatable connected to each other. Preferably one or more of the release positions are achieved by rotating first mount part 60.1 away from second mount part 60.2, the latter preferably fixed to the vehicle door. FIG. 2*a* shows a preferred embodiment in which the elongated hole on the handle 10 is on the same handle side as the rotational point between first and second mount part 60.1, 60.2, allowing for a better stiffness of the handle 10 esp. in deployed position. FIG. 2*b* shows a preferred embodiment where the elongated hole is on the lower part, on the same side as the coupling of link 22 to the handle 10, allowing for slight rotation of the handle around the two links 21, 21, when their ends are in deployed position close together. The following drawings are based on FIG. 2*b*; however, all additional features presented in the following drawings could also be combined with/used in the alternative mechanics according to FIG. 2*a*.

FIG. 2*c* shows and exploded view of parts of an example according to FIG. 2*b*. Link 22 is an upper hinge arm and link 21 a lower hinge arm. Lower hinge arm 21 is rotatable coupled by pin 21.5 to the first mount part 60.1 and engages (slidable and rotatable) with integrally formed pins on its other end with two elongated holes on the handle 10. Upper hinge arm 22 is rotatable mounted via pins 22.3 to the handle 10. Both hinge arms are interconnected rotatable via pins 23. The upper end of the hinge arm 22 is engaging (slidable and rotatable) in a guide section 63 in the top part of first mount part 60.1. Lower hinge arm 21 is pushed back to the first mount part 60.1 by a hinge arm spring 90; alternatively hinge arm spring 90 acts upon upper hinge arm instead of lower hinge arm, such that upper hinge arm is moving back the handle 10 into retracted position. The motor is mounted to the first mount part 60.1 preferably with motor bracket 33. It can be rotatable mounted (and rotating when moving, as in the first embodiment according to FIG. 1*a-f*) or fixed. The motor movement effects pushing a push rod which transfers its movement onto a motor adapter 32, the adapter 32 being, with motor movement, further pushed in between first mount part 60.1 and lower hinge arm. In an alternative embodiment the motor (or similar drive unit) is mounted (fixed or rotatable) to the second mount part and still engaging on the lower hinge arm.

The motor adapter 32 is preferably shaped like a wedge or it even has a more complex helix/spiral shape for enhanced contact to the lower hinge arm. First and second mount part 60.1 and 60.2 are rotatable mounted to each other by pins 62. At this point it should be mentioned that rotation could be achieved in a variety of ways (single pin, multiple pins, fixed pins on a piece, separate pins), which holds for all embodiments, without leaving the scope of this door handle assembly description. A mount part spring 100 engages onto first mount part such that the spring 100 applies a force from release position to deploy and/or retracted position. Microswitch 70 is mounted adjacent to the guide section 63 and preferably has the same function as in FIG. 1*a-f*. First mount part 60.1 has a hook 151 or loop (part of a Bowden cable actuating unit 150) engaging with the Bowden cable 110 and pulling on the Bowden cable into a recess 152 of the second mount part 60.2, when the first mount part 60.1 is rotated against the second mount part 60.2. Second mount part 60.2 has a Bowden cable mount 153 guiding the Bowden cable over the recess 152.

FIG. 2*d*-2*g* show side views of retracted position (FIG. 2*d*), deployed position (FIG. 2*e*), first release position (FIG. 2*f*) and second release position (FIG. 2*g*). The handle 10 preferably has preferred stabilizing rib(s) 10.3 at least partly on its back end, that are configured to engage with the first mount part 60.1 in deploy and release positions. In FIG. 2*e*, the microswitch 70 is ready to be actuated, whereas in FIG. 2*f* it is being actuated. In this first release position (FIG. 2*f*), the hinge arms 21, 22 and the handle 10 are building a rigid block. In the second release position (FIG. 2*g*), the Bowen cable (hook and Bowden cable not visible) is pulled by first mount part 60.1 due to the rotation against the second mount part 60.2 about pin 62 Hence, the Bowden cable is being actuated—preferably in case emergency—due to rotation of the rear housing 60.1 around that pin 62.

FIG. 2*h* shows only the first mount part and the parts movable with the first mount part 60.1 against the second mount part 60.2; deployed position.

FIG. 2*i*, 2*j*, 2*k* show the actuation of the microswitch by the upper hinge arm. The upper hinge arm preferably has a pin 22.4 having a surface which is not rotation symmetric in the section neighboring the microswitch, e.g. the pin 22.4 being flattened or cut out at a specific axial portion. Hence, when the pin 22.4 sliding in the guide section 63 is passing the microswitch between deploy and retracted state, no actuation of the switch is taking place, whereas, as the upper hinge arm has different rotational position when in deployed position, the pin 22.4 is actuating the microswitch when the handle 10 is pulled a few mm starting from the deployed position.

FIG. 2*l*, 2*m*, 2*n* show an alternative actuation and positioning of the microswitch 70. The microswitch 70 is positioned on the lower hinge arm 21 and the handle 10 presses the switch 70 when the handle 10 is pulled a few mm starting from the deployed state.

Preferably, the door handle assembly also comprises a locking cylinder 160 as shown in FIG. 2*o*, 2*p*—two different vertical sections through the door handle assembly. Preferably it is positioned below the handle. Alternatively, the locking cylinder 160 is positioned and hidden below one side end of the handle (front end or back end) and becomes visible when the handle is deployed and/or released position. Ends of upper and/or lower hinge arm preferably encompass the locking cylinder 160.

In a further alternative that is not shown the switch may be positioned on the first mount part and actuated by the second mount part at a defined rotational position or vice versa.

FIG. 3 and all subfigures refer to another embodiment of a door handle assembly. FIG. 3*a*-3*d* depict the principle of the door handle 10 movement. The door handle 10 is pivotally mounted via a mechanism: a pivot arm 21 mounted pivotally about an axis 21.1. FIG. 3*a* shows the flush position, FIG. 3*b* the deployed position, FIG. 3*c* a first release position for electronic actuation (e.g. by a switch, like switch 70) and FIG. 3*d* a second release position for mechanic actuation.

Figure 3D:
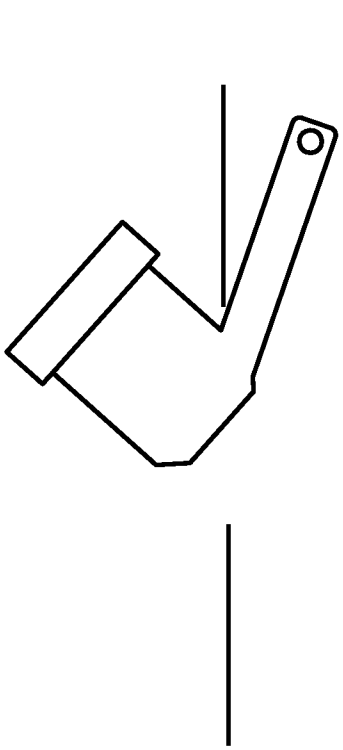
Figure 3C:
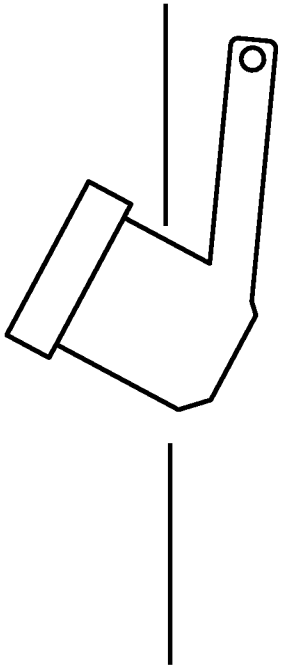
Figure 3B:
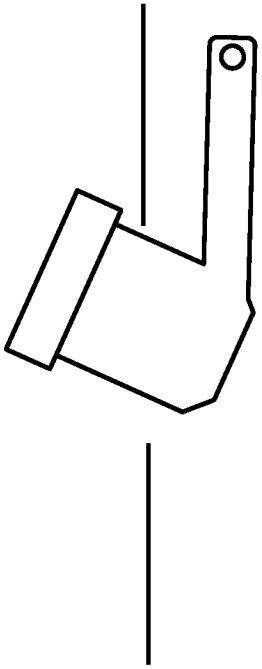
Figure 3A:
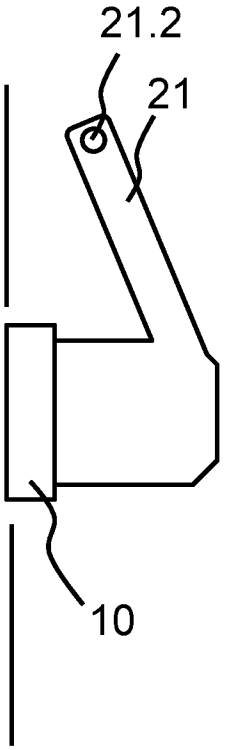
Figure 3E:
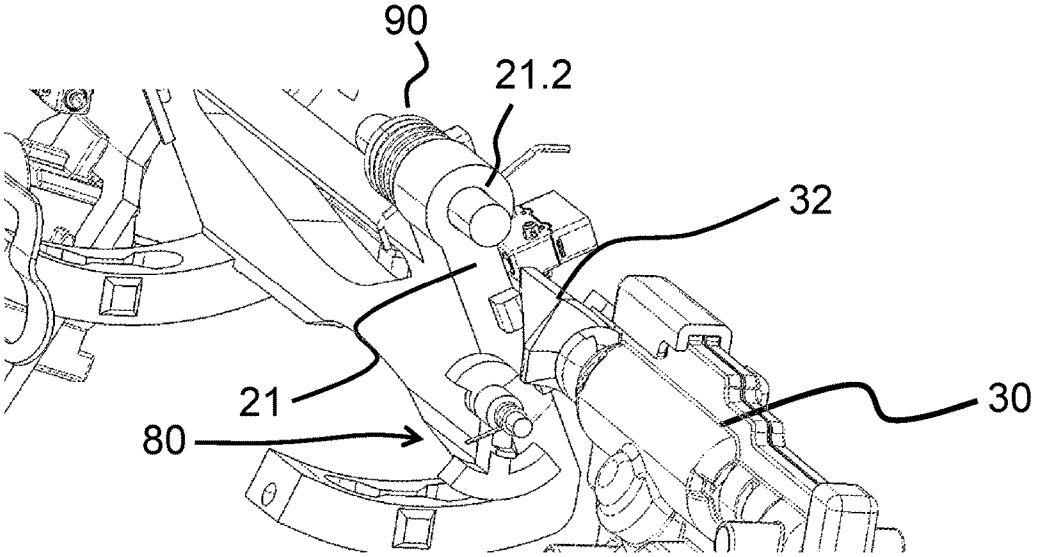
Figure 3F:
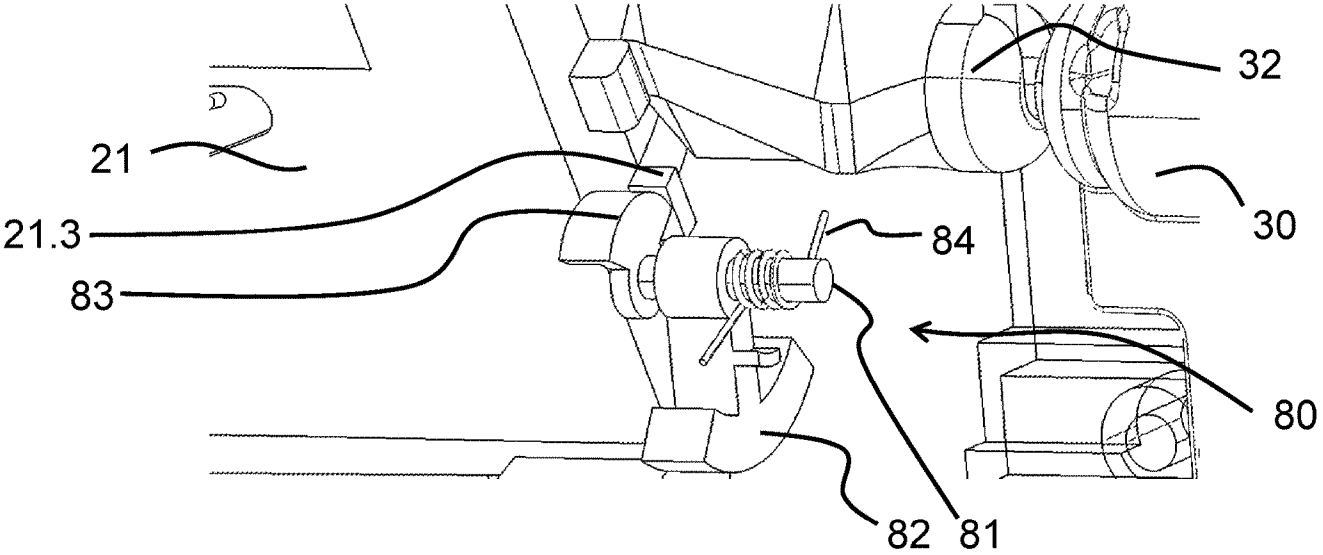
Figure 3G:
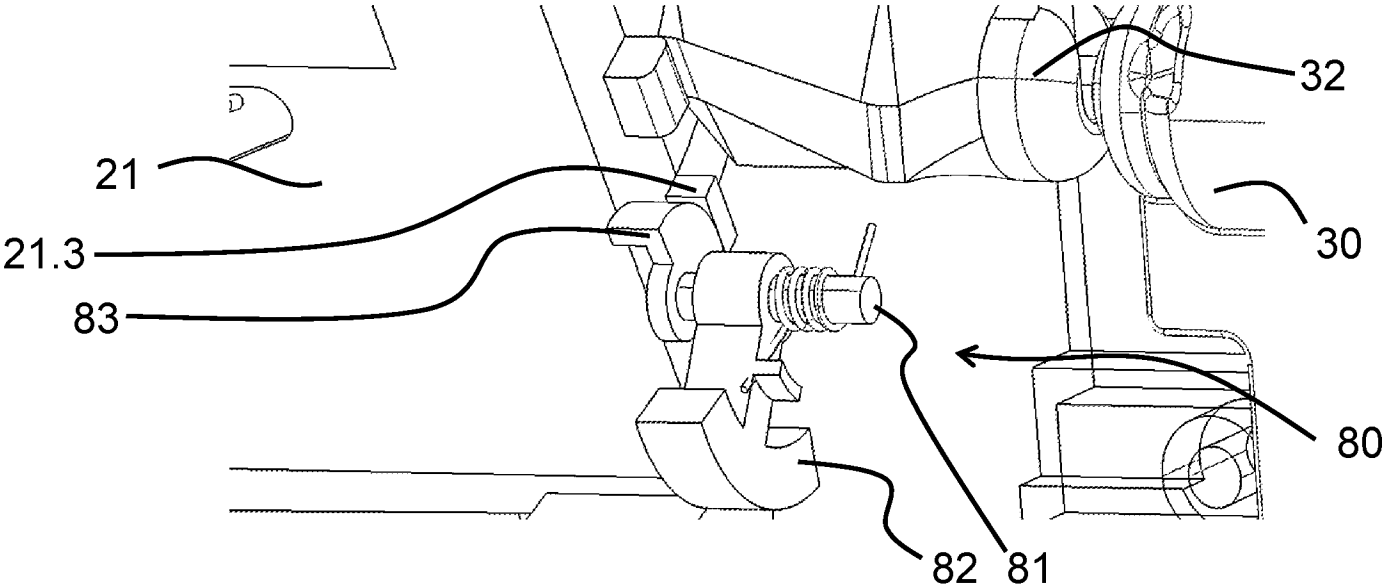
Figure 3H:
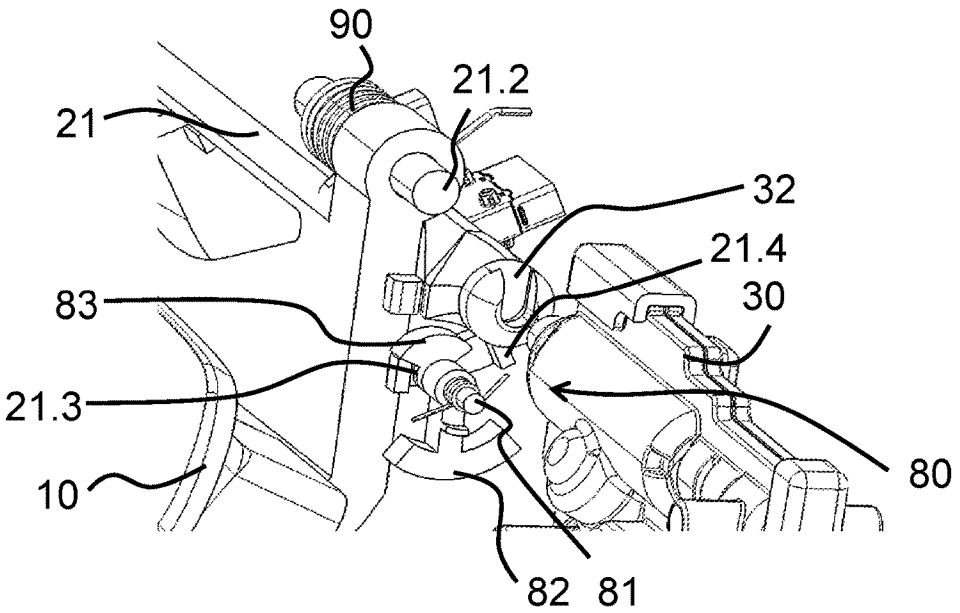
Figure 3I:
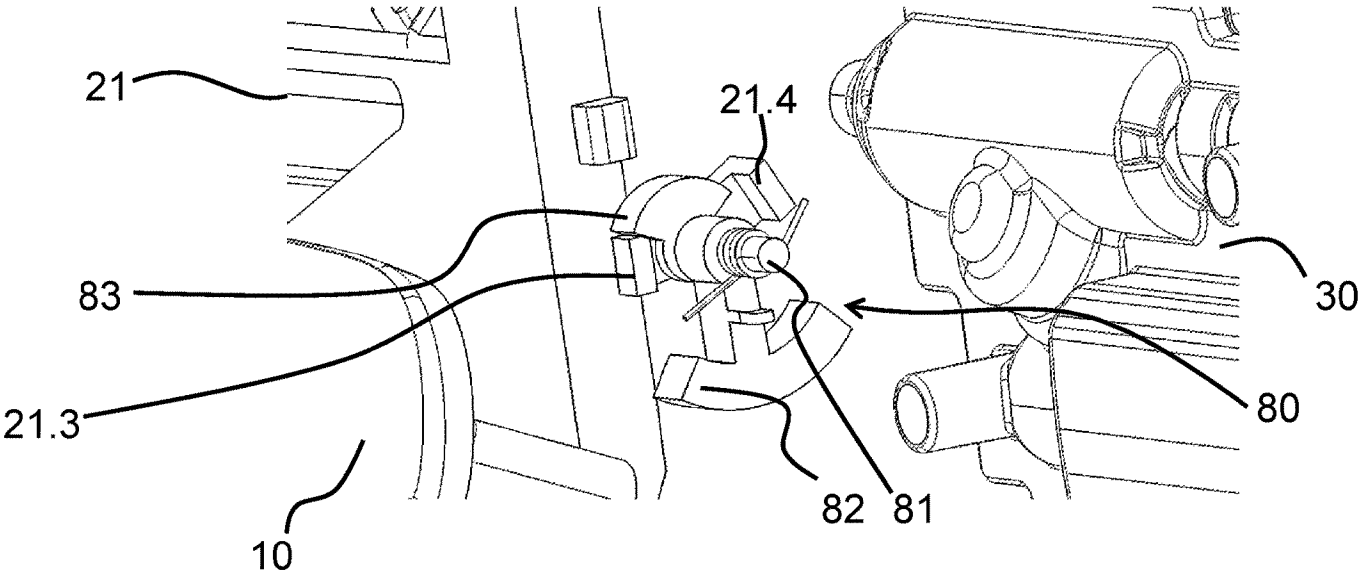
Figure 3J:
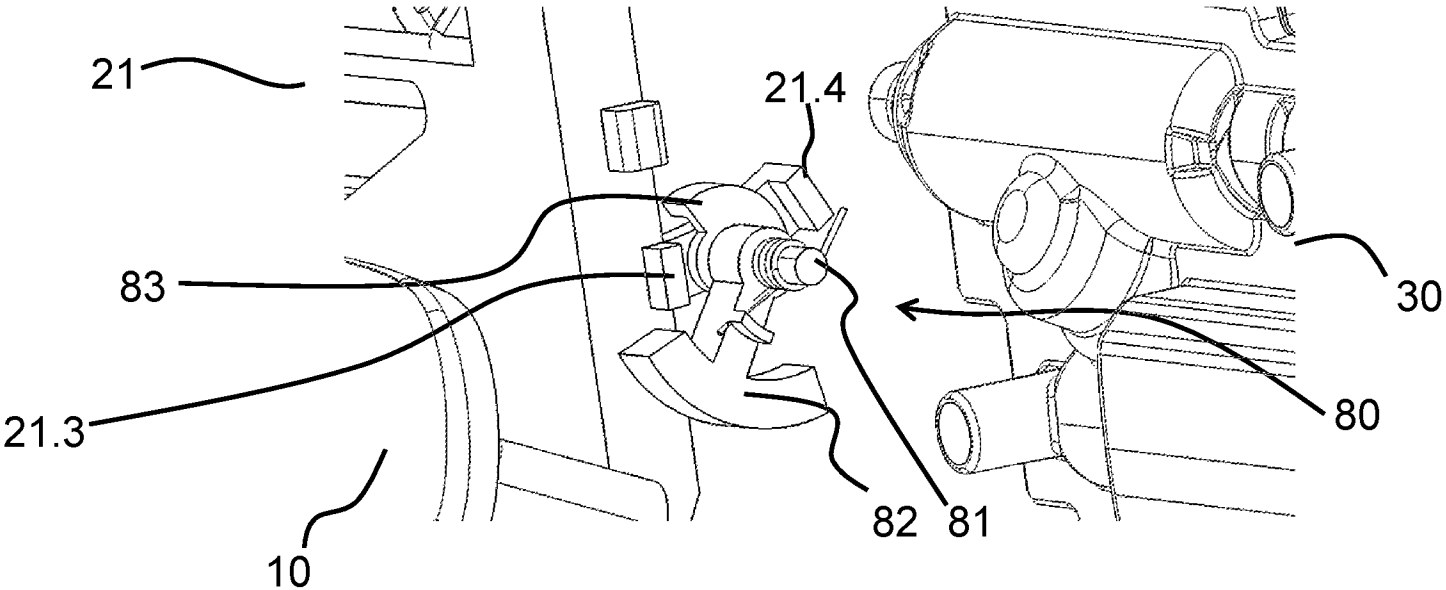
Figure 3K:
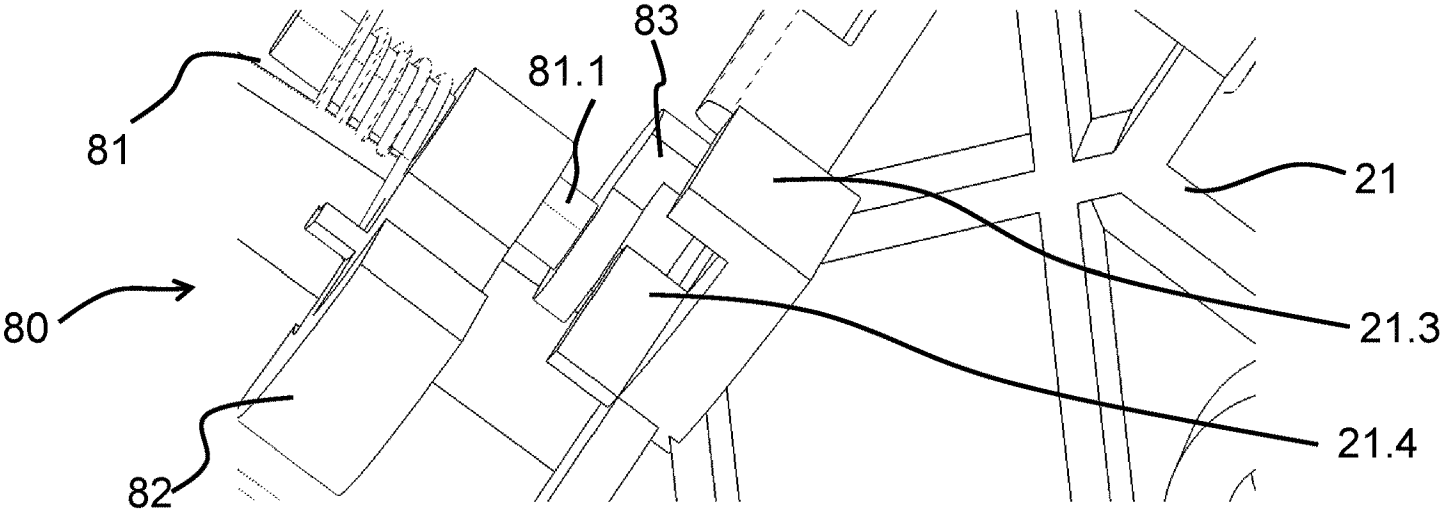
Figure 3L:
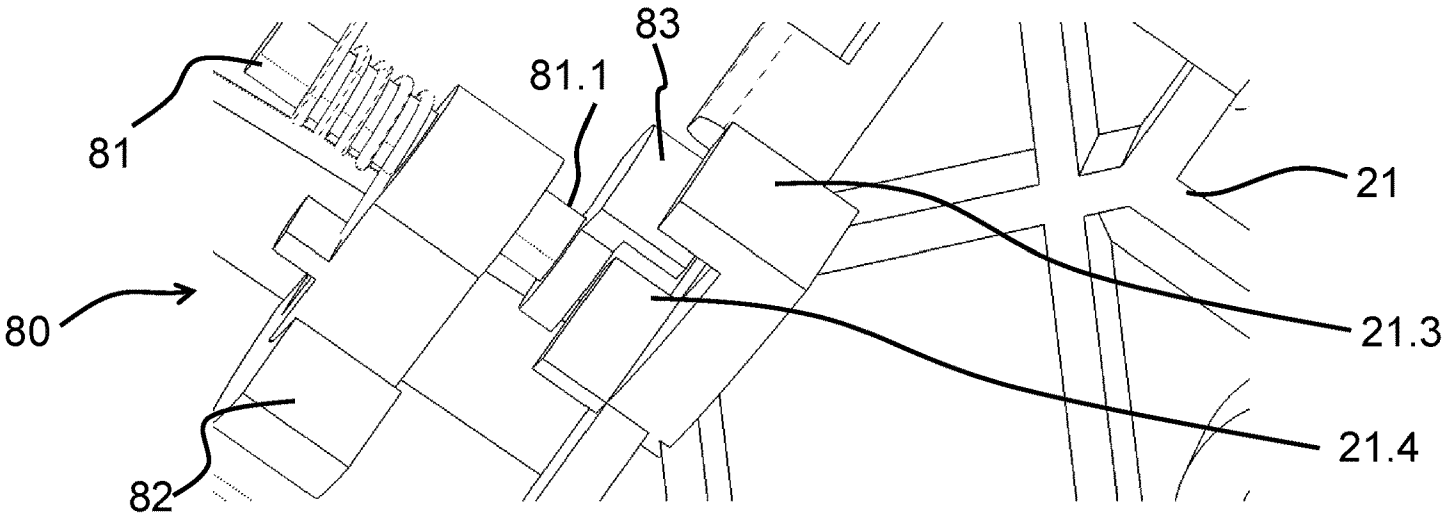

FIG. 3*e* to FIG. 3*p* show detailed perspective views of a possible realization of a door handle according to FIG. 3*a*-3*d*, wherein, for sake of better visibility, some parts have been made invisible. In drawings 3*e*, 3*f*, 3*g*, 3*m*, 3*o*, the handle 10 is in flush position (handle and pivot arm are green, dark), in drawings 3*h*, 3*i*, 3*j*, 3*k*, 31, 3*n*, 3*p*, the handle 10 is in deployed position (handle and pivot arm are yellow, bright). FIGS. 3*k* and 3*l* are backside views. Drive unit 30 is configured to engage via a motor adapter 32 with the pivot arm 21 for moving the handle 10 from flush position to deployed position. In FIG. 3*h* a push rod pushing the motor adapter 32 onto pivot arm 21 is not shown, in FIGS. 3*i* and 3*j*, motor adapter 32 and push rod are not shown. In FIG. 3*e*, the handle 10 is made invisible. One advantageous aspect of the embodiment is shown especially in FIG. 3*e*-31. The door handle assembly comprises an inertia lock 80. The inertia lock 80 comprises an inertia weight 82 fixed via axis 81 to a part that is in fixed relation to the handle mount 60, hence the pivot arm 21 is movable in relation to the axis 81. The part on which axis 81 is articulated is not shown. Spring 84 forces inertia weight 82 to the rest position (shown in FIG. 3*e*, 3*f*, 3*k*, 3*h*, 3*i*—inertia weight is dark red). The inertia lock 80 comprises a lock element 83 rotating with the inertia weight 82. The pivot arm 21 comprises two block elements, a flush block element 21.3 configured to engage with the lock element 83 when handle 10 is in flush position and a deploy block element 21.4 configured to engage with the lock element 83 when handle 10 is in deployed position. FIG. 3*g* shows the lock element 83 engaging with the flush block element 21.3. FIG. 3*j* and FIG. 3*l* show the lock element 83 engaging with the deploy block element 83. When the lock element 83 is in rest position, the block elements 21.3, 21.4 can pass the lock element. As apparent from FIGS. 3*k* and 3*l*, an optional spacing 81.1 between inertia weight 82 and lock element 83 is provided for a 2-sided articulation of the inertia weight 82.

Figure 3M:
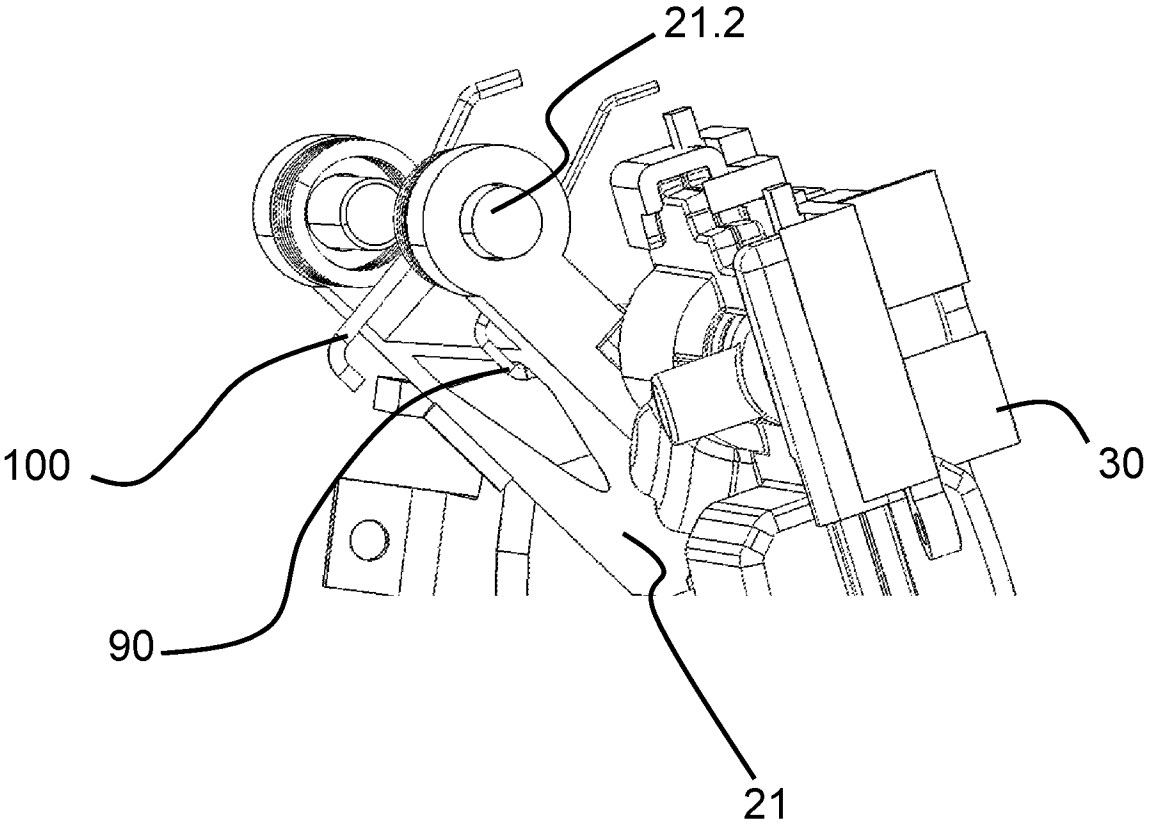
Figure 3N:
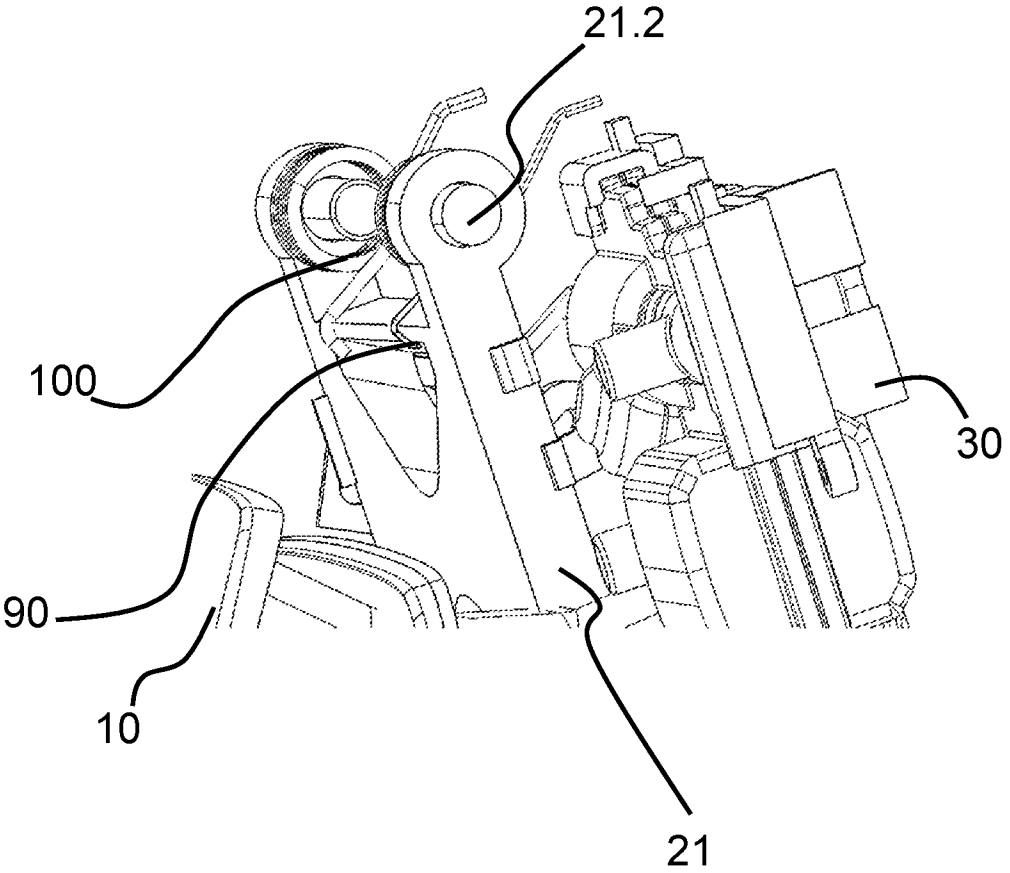

FIGS. 3*m* and 3*n* refer to another advantageous aspect, which consists in the use of two different springs 90, 100 (as in the second embodiment). The first spring 90 (also visible in FIGS. 3*e* and 3*h*) is permanently engaging the pivot arm 21, forcing the handle 10 into flush position. The second spring 100 only acts on the pivot arm 21 in addition to the first spring 90 as soon as the handle has reached (coming from the flush position) the deploy position as only then, one end of spring 100 hooks onto pivot 21, as shown in FIG. 3*n*. The position, at which spring 100 hooks onto pivot arm 21, could also be a position, at which the handle 10 is rotated further outwards, e.g., shortly after the first release position. The first spring 90 has, for example, a weak restoring force wherein the second spring 100 has a stronger restoring force for preventing unintentional mechanic door actuation by the Bowden cable.

Figure 3O:
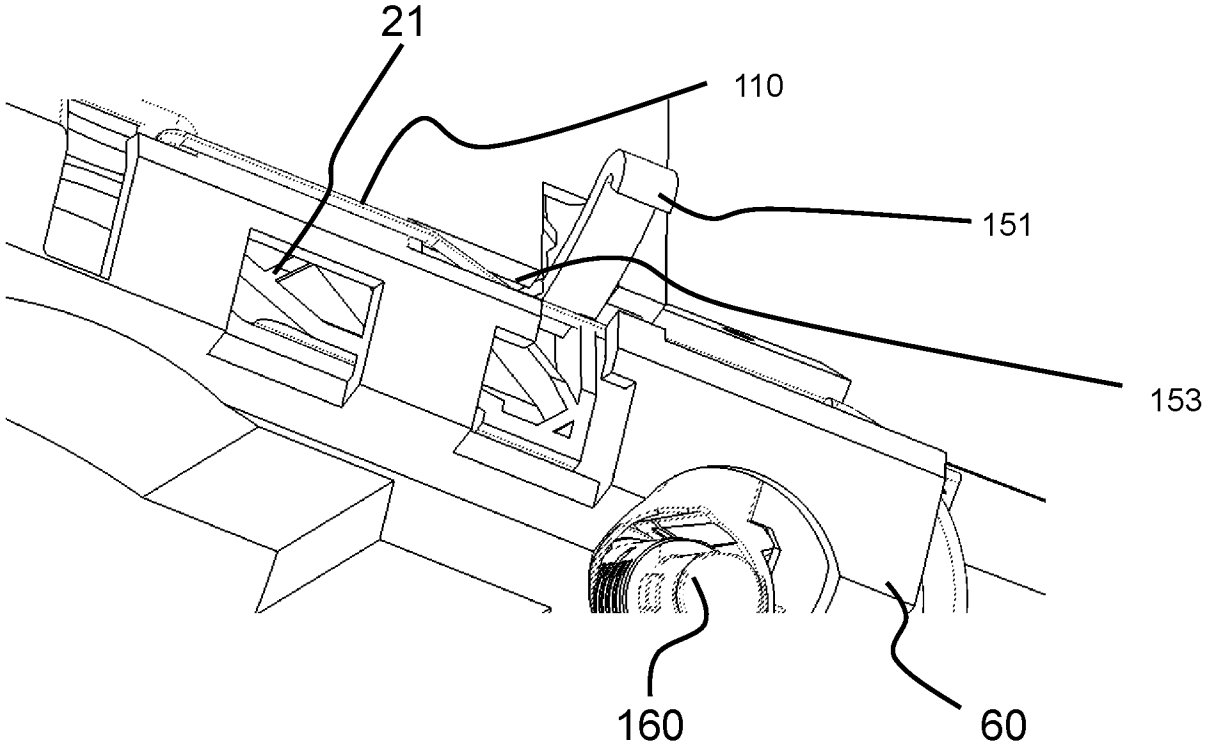
Figure 3P:
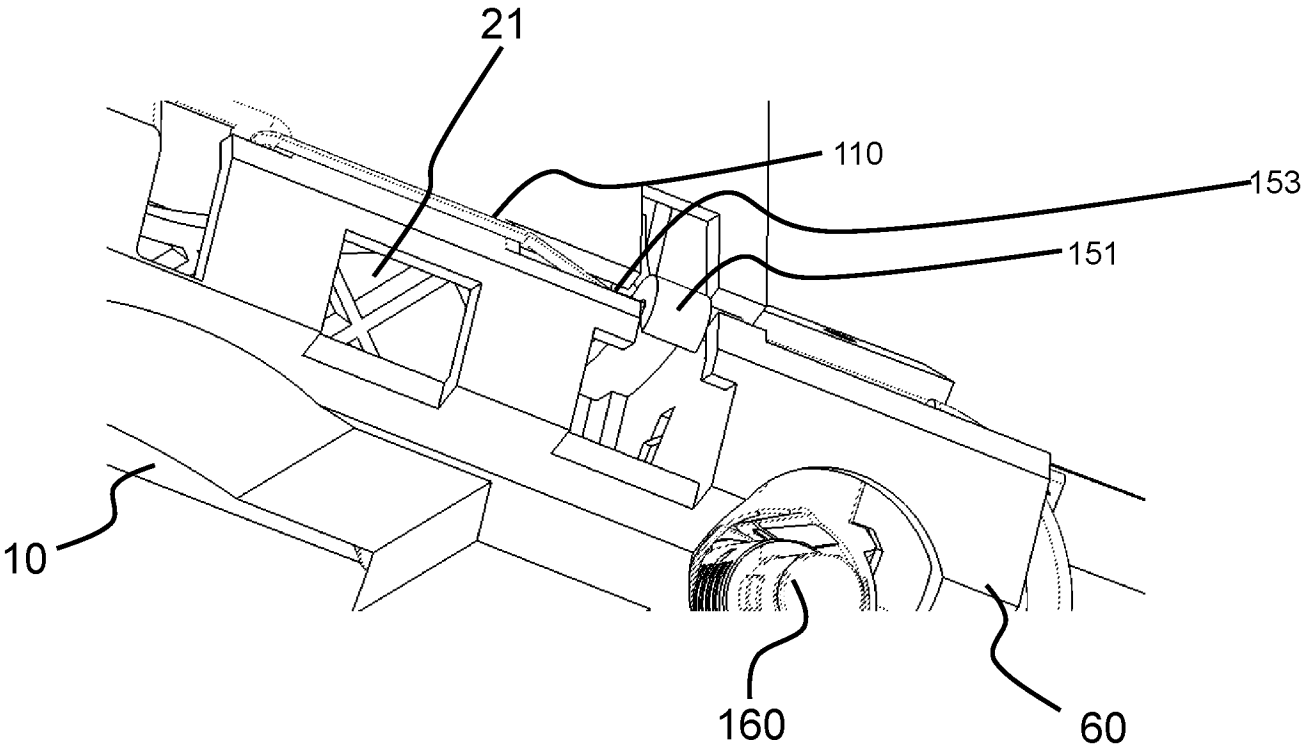

FIGS. 3*p* and 3*o* refer to another advantageous aspect, which is the Bowden cable actuation unit 150 comprising a hook 151, fixed to the pivot 21 arm engaging and pulling on the Bowden cable 110 into a recess 152 of the handle mount (housing) 60 with a translation of 2:1 when the handle 10 is moved in direction of the second release position. Preferably, the hook 151 is lifted away from the Bowden cable 110 when the handle 10 is in flush position.

Figure 4A:
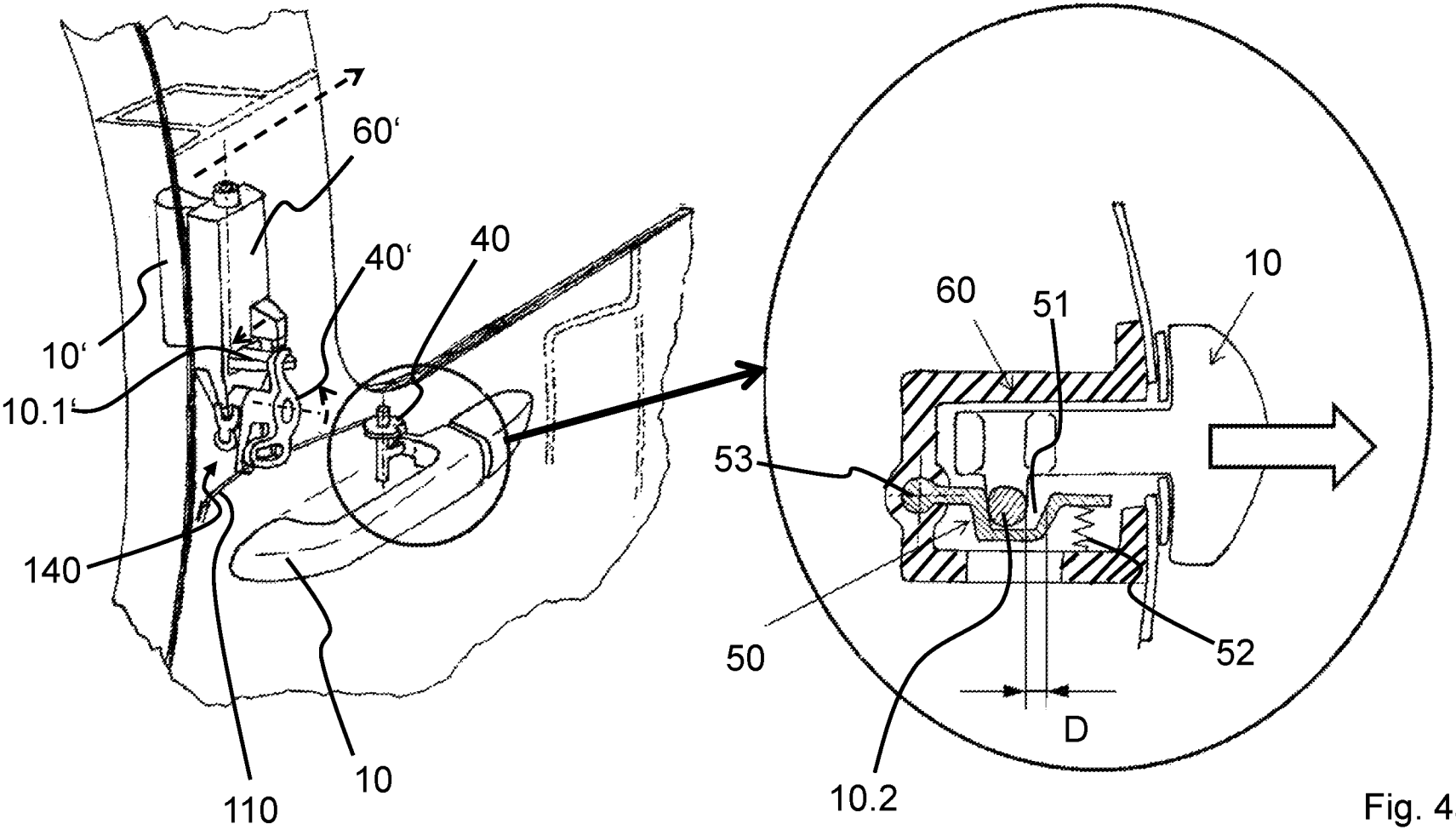

FIG. 4*a* shows an overview and a detailed view of a door handle assembly comprising an inner door handle 10' and an outer door handle 10. On the left a perspective overview is shown and on the right a section through a part of the outer door handle 10. The door handles 10, 10' are coupled to each other and configured to pull on the same Bowden cable 110 leading to the door lock. Similar to the handle assembly in FIG. 1*a*-1*d*, each handle 10, 10' engages with a respective pivot element 40, 40', the pivot elements 40, 40' engaging with the Bowden cable transmission 110. A movement of the handle 10' is transferred via a handle protrusion 10.1' onto the pivot element 40', similar for the outer door handle 10. The inner door handle 10' is held by a handle mount 60'. The inner door handle 10' engages at a handle protrusion 10.1' onto a pivot element 40', which in turn engages with the Bowden cable transmission 110 at a first engaging section and the outer door handle 10 engages via pivot element 40' with the Bowden cable transmission 110 at a second, different here approximately 10 cm apart engaging section. The door handle 10' is preferably mounted in a vertical window frame part next to a door window. The handles 10, 10' are preferably mounted adjacent to the same corner of the door window and over-corner. The assembly comprises a handle decoupling unit 140 decoupling the movement of the handles 10, 10' both movement sequences from each other. The handle decoupling unit 140 comprises an elongated hole, in which a nipple directly coupled to the Bowden cable transmission 110 is guided. Here, the Bowden cable transmission 110 comprises two parts separate from each other, one between handle 10' and handle 10 and another between handle 10' and the door lock, and the handle decoupling unit 140 connecting both parts to each other (as shown later in detail in FIG. 5*c*, however without having pivot element 40' split into two parts 40.1' and 40.2').

The inner door handle 10' actuation is as follows: pulling the handle 10' (dashed arrow in upper-right direction) causes a movement of the handle protrusion 10.1 in the opposite direction, causing the pivot element 40' pivoting anti-clockwise and thereby pulling the Bowden cable transmission 110. The outer door handle 10 actuation is as follows: pulling the strap handle 10 causes a clockwise rotation of pivot element 40, causing an anti-clockwise rotation of pivot element 40' and thereby pulling the Bowden cable transmission 110.

Like in the embodiments shown before, the door handles 10, 10' of the door handle assembly have at least a rest position and at least one release position, in which a door lock/door lock function (e.g., unlocking and/or opening) is actuated.

The outer handle 10 provides two release positions. The amount of handle movement to the first release position is less, cf. distance D, than the amount of handle movement from the first release position to the second release position. The arrival of the handle 10 in the first release position triggers an electric signal. The arrival of the handle 10 in the second release position strictly mechanically actuates the door lock, through the Bowden cable 110.

Figure 4B:
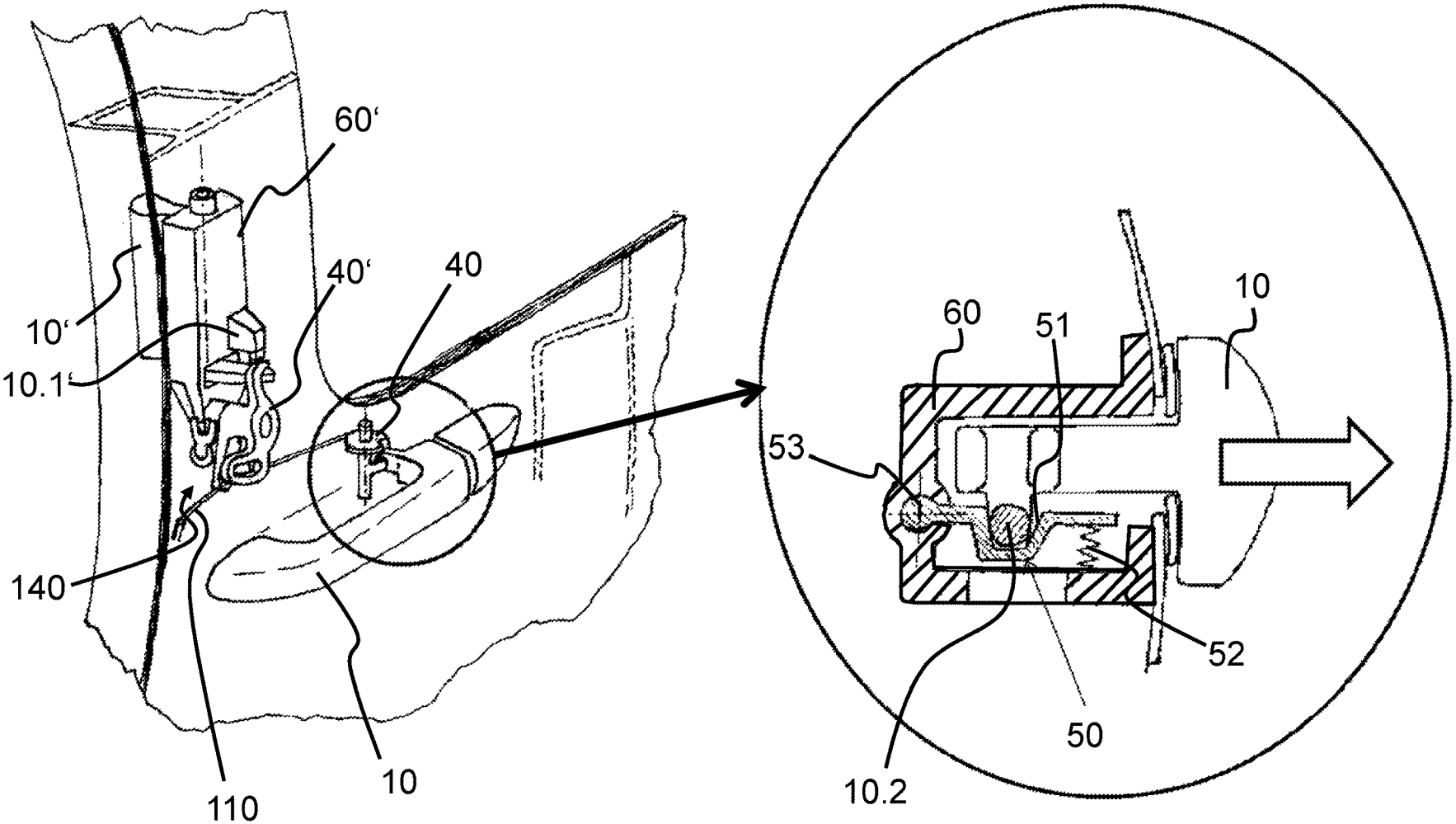

At this point attention is drawn to FIG. 4*b*, which shows in principle the same setup as FIG. 4*a*, however the outer handle 10 has only one release position (which confers to the second release position of the variant shown in FIG. 4*a*) and preferably furthermore a press button as a further interface to the user, which is fixed directly to the handle 10. The arrival of the handle 10 in the first release position strictly mechanically actuates the door lock, through the Bowden cable 110.

Back to FIG. 4*a*: The door handle assembly comprises, like the embodiment shown in FIG. 1*a*-1*d*, a retaining element 50 configured to define a predetermined threshold of a peak force necessary to bring the handle 10 to the second release position (FIG. 4*a*) or to the release position (FIG. 4*b*), whereby the retaining element releases the handle movement after overcoming the threshold. The retaining element 50 is spring 52 loaded and pivotable around axis 53 and thereby connected to the handle mount 60. The retaining element 50 comprises a step forming trough 51, into which a pin 10.2 of the handle 10 engages before overcoming the threshold and which the pin 10.2 has to overcome by displacing the retaining element 50 away from itself against the spring 52. Here, two release positions are provided as the through 51 is larger than the pin 10.2. The first release position is located at the point where the pin 10.2 hits the right end side of the through 51, hence, the step. In FIG. 4*b*, the through 51 is as large as the pin 10.2, to provide a snuggly fit in the shown position (rest position), which fixates the handle 10 in the rest position by a certain threshold force.

E.g., in an emergency, mechanic actuation of the door is achieved by strongly pulling on the handle 10 and thereby flipping over the retaining element 50, whereas otherwise the door is actuated electronically via either a switch to be switched via bringing the handle 10 into the first release position (the case of the embodiment shown in FIG. 4*a*) or the switch integrated into the handle 10 (e.g., covered by a flexible surface) to be pressed directly by the user (in the case of the embodiment shown in FIG. 4*b*).

Figure 5A:
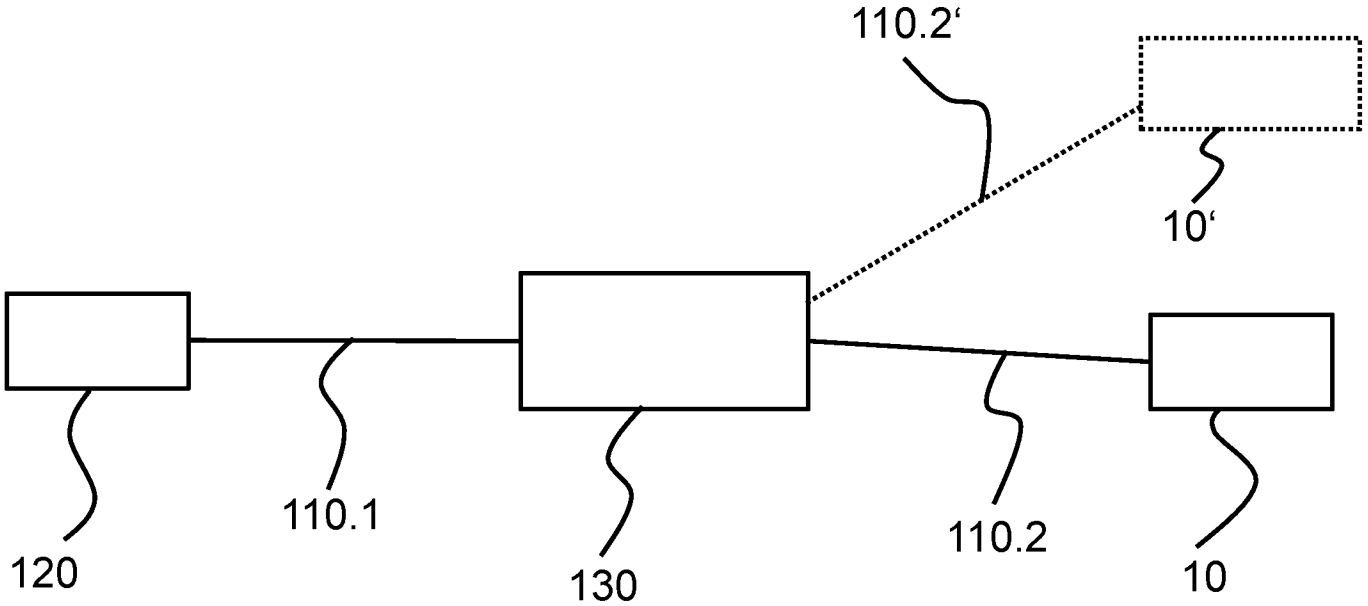

FIG. 5*a* shows a door handle assembly comprising a Bowden cable coupling unit 130, configured to be switched between two different states wherein in one state the Bowden cable transmission 110 between one door handle 10 or one or both of the door handles (in case of inner 10' and outer 10 door handle) is decoupled and in the other state the Bowden cable transmission 110 between the door handle 10 or one or both of the door handles 10, 10' is coupled. Here, the coupling unit 130 couples and decouples a first part of the Bowden cable transmission 110, which is the lock Bowden cable 110.1 between the Bowden cable coupling unit 130 and the door lock 120, from and to a second part of the Bowden cable transmission 110, which is the handle sided Bowden cable 110.2 (or in addition the second handle sided Bowden cable 110.2' in case of inner door handle 10' and outer door handle 10 being coupled together according to the invention).

Figure 5B:
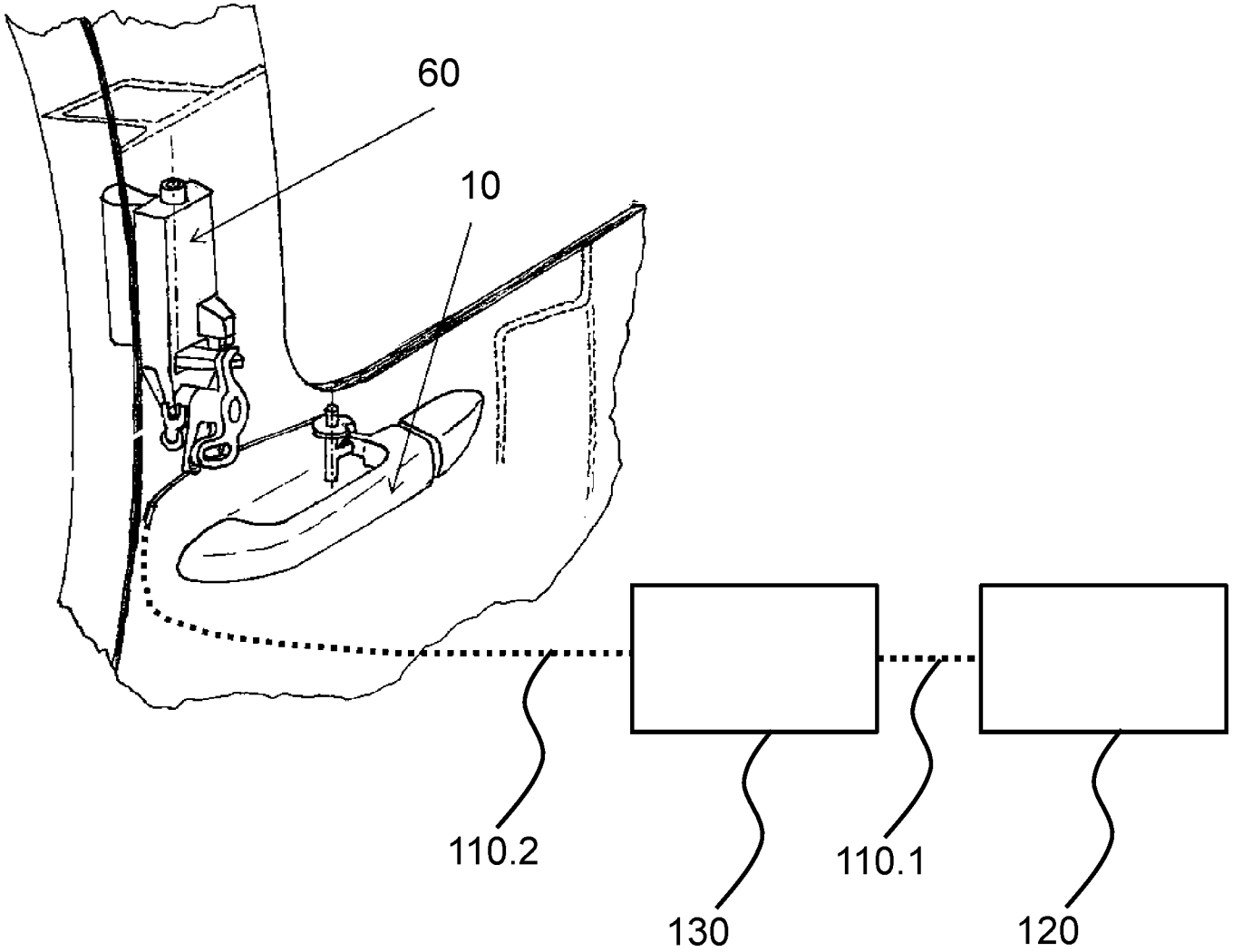
Figure 5C:
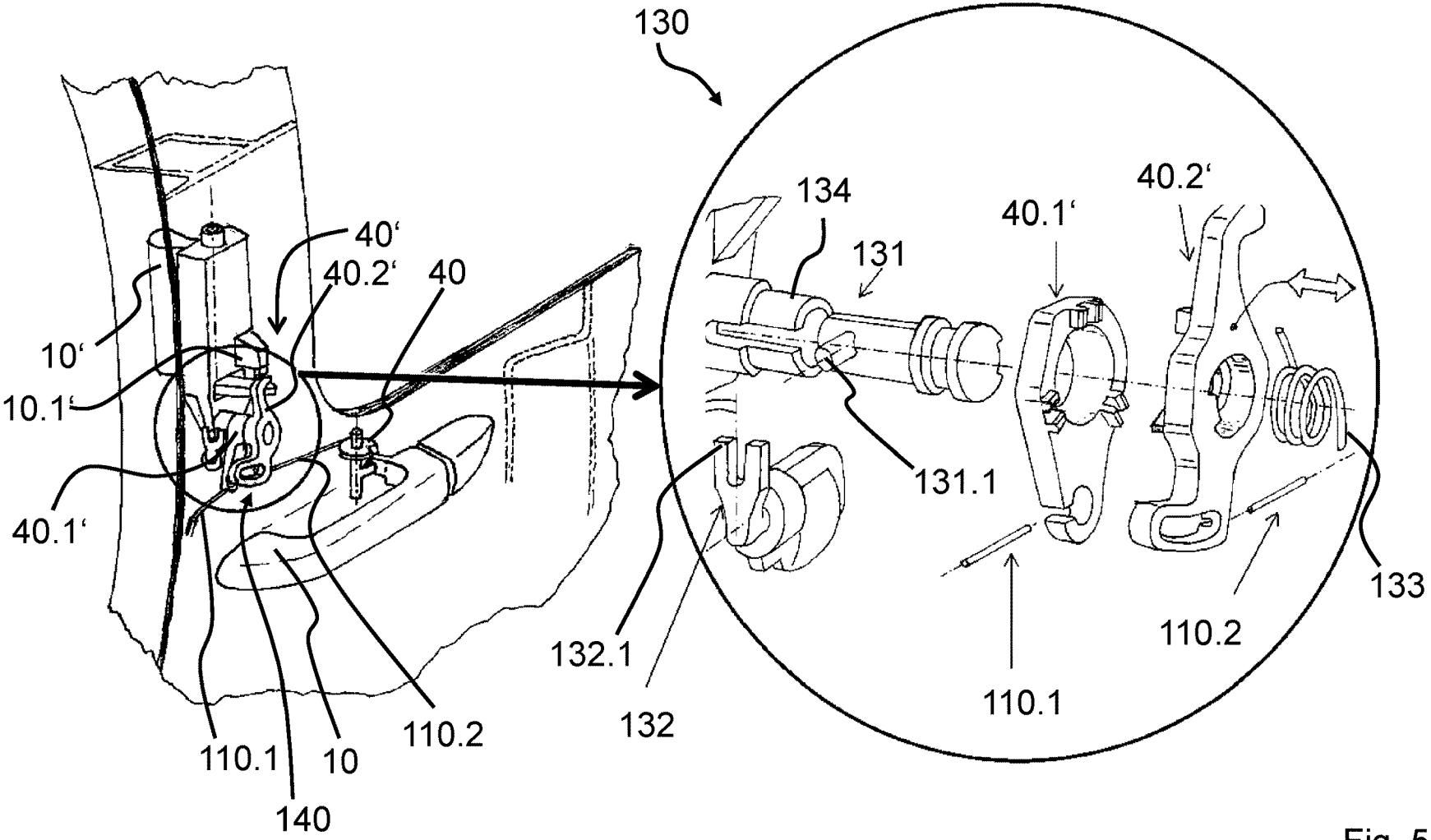

FIGS. 5*b* and 5*c* show, based on FIGS. 4*a* and 4*b* and 5*a*, two different examples for integrating such Bowden cable coupling unit 130 in a door handle assembly. In FIG. 5*b*, the Bowden cable coupling unit 130 is closer to the door lock 120 (measured by Bowden cable path length) than to the inner door handle 10'.

In FIG. 5*c*, the Bowden cable coupling unit 130 is part of the coupling of the inner door handle 10' to the Bowden cable transmission 110. The Bowden cable coupling unit 130 comprises an actuator 132, mechanically shifting an engaging member, a pin 131.1 of a coupling shaft 131, via a fork part 132.1 of the coupling actuator 132 for axially shifting the shaft 131 between the two different states. The Bowden cable coupling unit 130 further comprises as a component the pivot element 40' of the inner door handle 10'. The pivot element 40' is divided into two pivot parts, a first pivot part 40.1' being mounted axially fixed (axial fixation not shown) on a sleeve portion 134 in which the coupling shaft 131 is held axially movable. The second pivot part 40.2' is mounted axially fixed on the coupling shaft 131 and therefore, together with the shaft 131 axially movable with respect to the first pivot part 40.1' by the actuator 132. Both pivot parts 40.1' and 40.2' are pivotable around the shown geometric axis. The second pivot part 40.2' is spring 133 loaded clockwise into its rest position and comprises the elongated hole as part of the handle decoupling unit 140, and in the hole, the nipple of a the handle sided Bowden cable 110.2 leading to the outer handle 10 is guided. The lock Bowden cable 110.1 leading to the door lock is hooked into the first pivot part 40.1'. When axially close together, first and second pivot part 40.1', 40.2' are rotatably fixed against each other, hence synchronized, here due to preferable interlocking tooth elements, and when they are far enough apart from each other, they can be rotated against each other. For decoupling, the coupling unit 130 moves first and second pivot part 40.1', 40.2' apart via coupling actuator 132. In that position, the movements of the inner door handle 10' or the outer door handle 10 still cause the second pivot part 40.2' to pivot, however, this movement is not transferred to the first pivot part 40.1' and therefore not to the lock Bowden cable 110.1. Vice versa, for coupling, the coupling unit 130 moves first and second pivot part 40.1', 40.2' together via coupling actuator 132. In that position, the movements of the inner door handle 10 or the outer door handle 10 cause the second pivot part 40.2' to pivot and this movement is transferred to the first pivot part 40.1' and therefore to the lock Bowden cable 110.1.

It is to be noted that in FIGS. 4*a* to 5*c*, the inner door handle 10' and outer door handle 10' could also be exchanged with each other, such the door handle 10' is an outer door handle and the door handle 10 is an inner door handle.

Figure 6A:
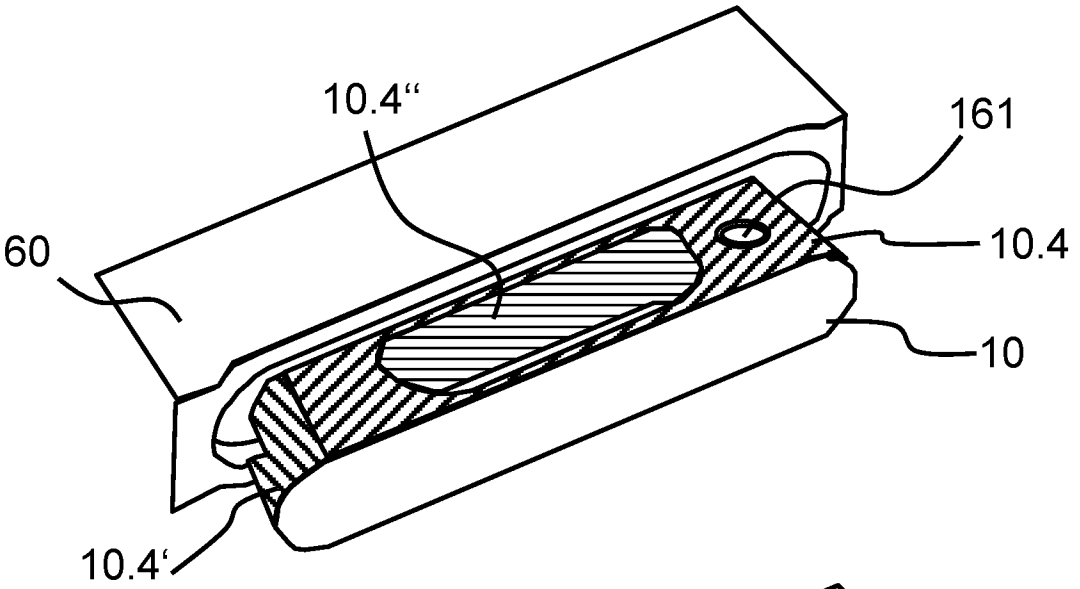
Figure 6B:
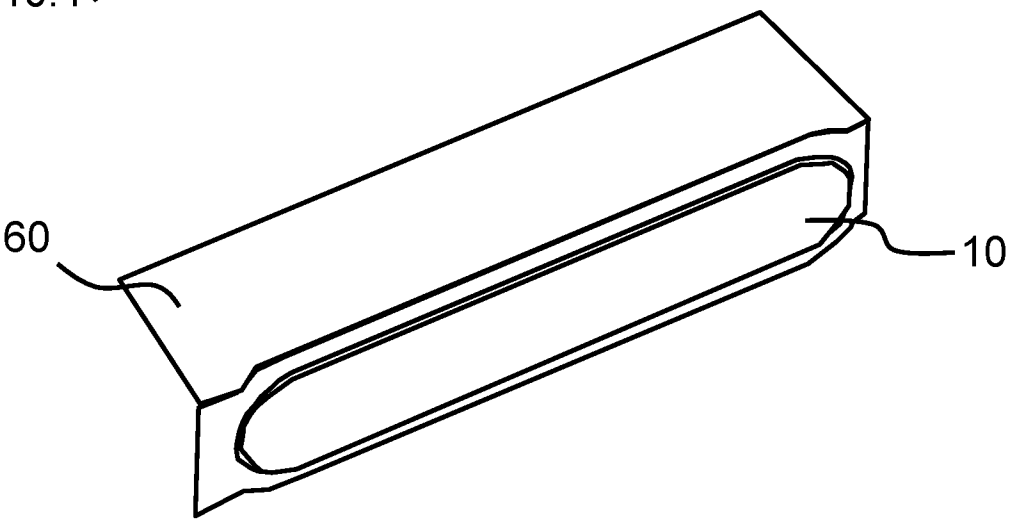

FIGS. 6*a* and 6*b* show a handle assembly with a hidden switch actuation element. The assembly comprises a manually operable switch, wherein the switch comprises a switch actuation element 161, here a press button, which is hidden, and not manually accessible and not operable, when the handle 10 is in the flush or retracted position (FIG. 6*b*), and manually operable when the handle 10 is in the deployed position (FIG. 6*a*) The handle 10 has a handle surface area 10.4, 10.4', 10.4", here the shade area. This area is, when the handle 10 is in the flush or retracted position (FIG. 6*b*) hidden, and not manually accessible, under a surface of the handle support 60. And this area is manually accessible and visible when the handle 10 is in the deployed position (FIG. 6*a*), The switch actuation element 161 is positioned on or within this handle surface area 10.4. The assembly is configured to retract the handle 10 to the flush or retracted position upon operation of the manually operable switch.

In summary, although protection is sought as claimed, the invention in general comprises wider embodiments, which could be subject of different divisional or continuation applications, especially the following embodiments, which can of course be further combined with features from the above specification:

EMBODIMENT 1

Door handle assembly for a vehicle, wherein the assembly has a handle (10) mounted on a handle support (60), preferably fixed or fixable to a vehicle door, and the assembly has one or more rest positions and at least one release position of the handle (10), in which a door lock (120) or a door lock function (120) is a actuated.

EMBODIMENT 2

Assembly according to embodiment 1, wherein the assembly comprises a retaining element (50) configured to define a predetermined threshold of a peak force necessary to bring the handle (10) to the at least one release position, whereby the retaining element (50) is configured to release the handle movement after overcoming the threshold.

EMBODIMENT 3

Assembly according to embodiment 2, wherein the retaining element (50) is spring (52) loaded or has one or more flexible parts.

EMBODIMENT 4

Assembly according to embodiment 2 or 3, wherein the retaining element (50) is positioned next to a switch (70), preferably a microswitch, and the retaining element (50) is configured to switch, by its own movement, the switch (70) when a predetermined force lower than the peak force is applied to the handle (10) before overcoming the threshold.

EMBODIMENT 5

Assembly according to one of embodiments 2 to 4, wherein the retaining element (50) comprises a trough (51) or step, into which one of a pin (10.2) or an axis (22.2) or protrusion engages before overcoming the threshold and which the one of the pin (10.2) or the axis (22.2) or the protrusion has to overcome by displacing the one of the pin (10.2) or the axis (22.) or the protrusion and/or the retaining element (50) away from each other.

EMBODIMENT 6

Assembly according to embodiment 5 and embodiment 4, wherein the one of a pin (10.2) or an axis (22.2) or protrusion is supported in a longitudinal recess (61) and shiftable, preferably linearly movable, within this recess (61), and the retaining element (50) is mounted movably along a direction of the longitudinal expansion of the recess (61) and the one of a pin (10.2) or an axis (22.2) or protrusion is configured to push the retaining element (50) onto the switch (70), when the force lower than the peak force is applied to the handle (10) before overcoming the threshold.

EMBODIMENT 7

Assembly according to one of the preceding embodiments, wherein the assembly has at least two release positions of the handle (10).

EMBODIMENT 8

Assembly according to embodiment 7, wherein the arrival of the handle (10) in a first of the release positions triggers an electric signal.

EMBODIMENT 9

Assembly according to embodiment 8, wherein the arrival of the handle (10) in a second of the release positions causes a mechanic actuation of the door lock (120).

EMBODIMENT 10

Assembly according to one of embodiments 7 to 9, wherein the amount of handle movement to a first of the release positions is less than the amount of handle movement from the first release position to a second of the release positions.

EMBODIMENT 11

Assembly according to one of the preceding embodiments, wherein the assembly has an inertia lock (80).

EMBODIMENT 12

Assembly according to embodiment 11 and one of embodiments 7 to 10, wherein the inertia lock (80) is configured to prevent the handle (10) to move to the second release position.

EMBODIMENT 13

Assembly according to one of the preceding embodiments, wherein the assembly comprises a Bowden cable actuation unit (150) which comprises a hook element (151) that is retractable into a recess (152).

EMBODIMENT 14

Assembly according to embodiment 13, wherein a Bowden cable (110) is guided over the recess (152) and for actuating the Bowden cable (110), the hook element (151) is retracted into the recess and with retraction pulls the Bowden cable (110).

EMBODIMENT 15

Assembly according to one of the preceding embodiments, wherein the assembly has at least three different positions,

- a flush or retracted position, preferably representing a first rest position of the one or more rest positions, in which the handle (10) is flush or retracted with respect to an outer door surface,
- a deployed position, preferably representing a second rest position of the one or more rest positions, in which the handle (10) protrudes or protrudes to a greater extent than in the retracted position and the at least one release position.

EMBODIMENT 16

Assembly according to embodiment 15, wherein movement of the handle (10) between retracted and deployed position is provided via a drive unit (30).

EMBODIMENT 17

Assembly according to embodiment 16, wherein the drive unit (30) is movable with respect to the handle support (60).

EMBODIMENT 18

Assembly according to embodiment 16 or 17, wherein the drive unit (30) comprises a motor, a push rod and a motor adapter (32), wherein the adapter (32) is configured to be pushed in between the handle support (60), preferably a first part (60.1) of the handle support (60), and the handle (10) or a link (21,22), linking the handle (10) to the handle support (60).

EMBODIMENT 19

Assembly according to one of embodiments 16 to 18, wherein the handle (10) or some part of the assembly or an adjacent part of a vehicle door comprise one or more proximity sensors, which are connected to a control unit controlling the movement of the handle (10).

EMBODIMENT 20

Assembly according to one of embodiments 15 to 19, wherein the handle (10) is connected to the handle support (60) via two, preferably parallel linked, preferably non-crossing, links (21, 22) and rotational joints wherein one joint (22.1) also has a translational degree of freedom.

EMBODIMENT 21

Assembly according to embodiment 20, wherein a movement of the joint (22.1) having the translational degree of freedom along the translational degree of freedom is configured to mechanically actuate the door lock (120) or door lock (120) function.

EMBODIMENT 22

Assembly according to embodiment 20 or 21, wherein the joint (22.1) also having a translational degree of freedom is connecting one of the links (21, 22) to the handle support (60).

EMBODIMENT 23

Assembly according to one of embodiments 20 to 22 and one of embodiments 16 to 18, wherein one of the links (21, 22) is driven by the drive unit (30) and the other of the links (21, 22) is connected to the handle support (60) or to the handle (10) via the joint (22.1) also having a translational degree of freedom.

EMBODIMENT 24

Assembly according to one of embodiments 20 to 23, wherein the joint (22.1) having the translational degree of freedom comprises an axis (22.2) supported in a longitudinal recess (61) and linearly movable within this recess (61).

EMBODIMENT 25

Assembly according to one of embodiments 20 to 23, wherein the joint (22.1) having the translational degree of freedom comprises an axis (22.2) supported on a pivot arm (25), the pivot arm (25) being pivotally mounted around another axis with respect to the handle support (60).

EMBODIMENT 26

Assembly according to one of embodiments 20 to 25, wherein in the flush or retracted position, a mechanical transmission, preferably a Bowden cable transmission (110), to the door lock (120) is engaging the joint (22.1) having the translational degree of freedom and urging the joint (22.1) into a rest position with respect to the translational degree of freedom.

EMBODIMENT 27

Assembly according to one of claims 20 to 26, wherein the movement from flush position to the deployed position is defined by rotation about the rotational joints without translation along the translational degree of freedom.

EMBODIMENT 28

Assembly according to one of embodiments 15 to 19, wherein the handle (10) is connected to the handle support (60) via two links (21, 22) and rotational joints, wherein the two links (21, 22) are crossing each other and at the crossing point they are connected via a joint.

EMBODIMENT 29

Assembly according to embodiment 28, wherein on each of the handle (10) and the handle support (60) at least one of the rotational joints also has a translational degree of freedom, whereby preferably the at least one the rotational joint is a glide joint.

EMBODIMENT 30

Assembly according to embodiment 29, wherein the rotational joint of the handle (10) also having the translational degree of freedom is connecting a first link (21) of the links (21, 22) to the handle (10) and another rotational joint of said rotational joints is connecting a second link (22) of the links (21, 22) to the handle (10), wherein the rotational joint of the handle (10) also having a translational degree of freedom and said other rotational joint are on the same half, preferably lower half or part and preferably same side, of the handle (10).

EMBODIMENT 31

Assembly according to one of embodiments 29 to 30, wherein a connection point, preferably a pin (22.4), of the link (22), which connection point is connecting the link (22) to the handle support (60) at the rotational joint also having a translational degree of freedom, is configured to perform a movement along the translational degree of freedom when the handle (10) is moved from the flush or retracted position to the deployed position, wherein this movement comprises a reversal of the movement direction, such that the connection point is moving forth and back when the handle (10) is moving one-way from the flush or retracted position to the deployed position.

EMBODIMENT 32

Assembly according to one of embodiments 28 to 31, wherein the joint connecting the two links (21, 22) at the crossing point is a) in the flush or retracted position positioned on one side of a shortest straight line (24) connecting the two rotational joints, which connect the links (21, 22) to the handle support (60) and b) in the deployed position positioned on the other side of the shortest straight line (24) connecting the two rotational joints, which connect the links (21, 22) to the handle support (60).

EMBODIMENT 33

Assembly according to one of embodiments 1 to 32, wherein the handle support (60) comprises, preferably consists of, a first support part (60.1) and a second support part (60.2) which are rotatable connected to each other.

EMBODIMENT 34

Assembly according to embodiment 33, wherein one or more of the release positions, preferably a release position with mechanical actuation of the door lock, are achieved by rotating the first support part (60.1) with respect to second support part (60.2).

EMBODIMENT 35

Assembly according to one of embodiments 15 to 34 and embodiment 8, wherein the handle (10) is connected via a mechanism to the handle support, wherein the mechanism provides the at least two release positions wherein in the first of the release positions an electric switch (70) is switched for electric actuation of the door lock or door lock function and wherein in a second of the release positions another switch is switched or a mechanic actuation of the door lock or a door function is performed.

EMBODIMENT 36

Assembly according to embodiment 35, wherein the mechanism has two links or hinge arms (21, 22) connecting the handle (10) to the handle support (60).

EMBODIMENT 37

Assembly according to one of embodiments 15 to 36, wherein the assembly comprises a first spring (90) urging the handle (10) from the deployed to the retracted or flush position and a second spring (100) urging the handle (10) from one or more of the release positions to the deployed position or to another of the release positions.

EMBODIMENT 38

Assembly according to embodiment 37, wherein a restoring force or counterforce of the second spring (100) adds up to the restoring force or counterforce of the first spring (90). Preferably, the second spring (directly/indirectly) engages the handle or the mechanism only between and preferably including deployed and one or more of the release positions or only between and preferably including the first and the second release position, preferably excluding the first release position (closer to the deployed position).

EMBODIMENT 39

Assembly according to one of embodiments 15 to 38 and embodiment 11 or 12, wherein the inertia lock (80) is configured to provide a locking of the door handle (10) preventing a movement of the door handle (10) from the flush or retracted position to the deployed position and configured to provide another locking preventing a movement of the door handle (10) from deployed position to one or more release positions.

EMBODIMENT 40

Assembly according to one of embodiments 15 to 39, wherein the assembly comprises a manually operable switch, wherein the switch comprises a switch actuation element (161), preferably a press button, which is hidden, preferably not manually accessible or not operable, when the handle (10) is in the flush or retracted position, and manually operable when the handle (10) is in the deployed or the at least one release position.

EMBODIMENT 41

Assembly according to embodiment 40, wherein the handle (10) has a handle surface area (10.4, 10.4', 10.4")

a) which is, when the handle (10) is in the flush or retracted position, hidden, and preferably not manually accessible, behind or under a surface of a vehicle door surrounding the door handle or behind or under a surface of the handle support (60), b) and which is manually accessible, preferably visible, when the handle (10) is in the deployed or the at least one release position, wherein the switch actuation element (161) is positioned on or within this handle surface area (10.4)

EMBODIMENT 42

Assembly according to embodiment 40 or 41, wherein the assembly is configured to retract the handle (10) to the flush or retracted position upon operation of the manually operable switch (160).

EMBODIMENT 43

Assembly according to one of the preceding embodiments, wherein the assembly comprises an inner door handle (10') and an outer door handle (10).

EMBODIMENT 44

Assembly according to embodiment 43, wherein the handles (10', 10) are coupled to each other by being configured to pull on the same Bowden cable (110) leading to the door lock (120).

EMBODIMENT 45

Assembly according to embodiment 44, wherein the assembly comprises a handle decoupling unit (140) configured to decouple the movement of the handles (10', 10) from each other.

EMBODIMENT 46

Assembly according to embodiment 45, wherein the handle decoupling unit (140) comprises an elongated hole, in which a pin or nipple coupled to the Bowden cable (110) is guided.

EMBODIMENT 47

Assembly according to one of embodiments 45 to 46, wherein the Bowden cable (110) comprises two parts (110.1, 110.2) and the handle decoupling unit (140) is connecting both parts (110.1, 110.2) to each other.

EMBODIMENT 48

Assembly according to one of the preceding embodiments, wherein the handle assembly comprises a Bowden cable coupling unit (130), configured to be switched between two different states wherein in one state a Bowden cable transmission (110) between the handle (10) and the door lock (120) is decoupled and in the other state the Bowden cable transmission (110) between the handle (10) and the door lock (120) is coupled.

EMBODIMENT 49

Assembly according to embodiment 48, wherein the Bowden cable coupling unit (130) is positioned close to the door lock (120).

EMBODIMENT 50

Assembly according to embodiment 48 or 49, wherein the Bowden cable coupling unit (130) comprises an actuator (132), mechanically rotating and/or shifting an engaging member (40.1', 40.2') for shifting between the two different states.

EMBODIMENT 51

Assembly according to one of embodiments 48 to 50 and one of embodiments 41 to 47, wherein in the one state the Bowden cable transmission (110) between one or both of the door handles (10, 10') the door lock (120) is decoupled and in the other state the Bowden cable transmission (110) between one or both of the door handles (10, 10') the door lock (120) is coupled.

EMBODIMENT 52

Assembly according to embodiment 51, wherein the Bowden cable coupling unit (130) is configured to be switched to an additional state or two or more additional states.

EMBODIMENT 53

Assembly according to embodiment 52, wherein the states between which the Bowden cable coupling unit (130) is switchable, comprise a first state, in which the Bowden cable transmission (110) between the outer door handle (10) and the door lock (120) is decoupled and the Bowden cable transmission (110) between the inner door handle (10') and the door lock (120) is coupled and;

a second state, in which the Bowden cable transmission (110) between the outer door handle (10) and the door lock (120) is decoupled and the Bowden cable transmission (110) between the inner door handle (10') and the door lock (120) is decoupled and;

a third state, in which the Bowden cable transmission (110) between the outer door handle (10) and the door lock (120) is coupled and the Bowden cable transmission (110) between the inner door handle (10') and the door lock (120) is decoupled and;

a fourth state, in which the Bowden cable transmission (110) between the outer door handle (10) and the door lock (120) is coupled and the Bowden cable transmission (110) between the inner door handle ('10) and the door lock (120) is coupled.

The invention also has as a subject a door having a door handle assembly according to one of the preceding embodiments, a method of operating a door using a door handle assembly according to one of the preceding embodiments and a use of a door handle assembly according to one of the preceding embodiments for use in a vehicle side door.

| Reference signs | |
|---|---|
| 10 | handle |
| 10.1 | handle protrusion |
| 10.2 | pin |
| 10.3 | stabilizing rib |
| 10.4 | handle surface area |
| 21 | 1st link |
| 21.2 | axis |
| 21.3 | flush block element |
| 21.4 | deploy block element |
| 21.5 | pin |
| 22 | 2nd link |
| 22.1 | joint |
| 22.2 | axis |
| 22.3 | pin |
| 22.4 | pin |
| 23 | pin |
| 24 | shortest straight line |
| 25 | pivot arm |
| 30 | Drive unit/Motor |
| 31 | Push rod |
| 32 | Motor adapter |
| 33 | motor bracket |
| 40 | Pivot element |
| 40.1 | first pivot part |
| 40.2 | second pivot part |
| 50 | Retaining element |
| 51 | through |
| 52 | spring |
| 53 | axis |
| 60 | Handle mount/handle support |
| 60.1 | First mount part |
| 60.2 | Second mount part |
| 61 | recess |
| 62 | pin |
| 63 | guide section |
| 70 | microswitch |
| 80 | inertia lock |
| 81 | Axis |
| 81.1 | Spacing |
| 82 | inertia weight |
| 83 | lock element |
| 84 | spring |
| 90 | first spring |
| 100 | second spring |
| 110 | Bowden cable/Bowden cable transmission |
| 110.1 | lock Bowden cable |
| 110.2 | handle sided Bowden cable |
| 120 | door lock |
| 130 | Bowden cable coupling unit |
| 131 | coupling shaft |
| 131.1 | pin |
| 132 | coupling actuator |
| 132.1 | fork part |
| 133 | spring |
| 134 | sleeve portion |
| 140 | handle decoupling unit |
| 150 | Bowden cable actuation unit |
| 151 | hook element |
| 152 | recess |
| 153 | Bowden cable mount |
| 160 | locking cylinder |
| 161 | switch actuation element |

The invention claimed is:

1. A door handle assembly for a vehicle, wherein the assembly has a handle mounted on a handle support and the assembly has one or more rest positions and at least one release position of the handle, in which a door lock or a door lock function is actuated, wherein the assembly has at least three different positions, including:

a flush or retracted position, in which the handle is flush or retracted with respect to an outer door surface, a deployed position, in which the handle protrudes or protrudes to a greater extent than in the retracted position, and the at least one release position, wherein the handle is connected to the handle support via two links and rotational joints wherein one rotational joint also has a translational degree of freedom such that a movement of the rotational joint having the translational degree of freedom along the translational degree of freedom is configured to mechanically actuate the door lock or door lock function;

wherein the rotational joint having the translational degree of freedom connects one of the links to the handle support and the rotational joint having the translational degree of freedom (i) remains stationary when the handle moves from the flush or retracted position to the deployed position and (ii) moves along the translational degree of freedom when the handle moves from the deployed position to the at least one release position.

2. A door handle assembly according to claim 1, wherein movement of the handle between the flush or retracted position and the deployed position is provided via a drive unit and wherein one of the links is driven by the drive unit and the other of the links is connected to the handle support or to the handle via the joint also having the translational degree of freedom.

3. A door handle assembly according to claim 1, wherein the joint having the translational degree of freedom comprises an axis supported in a longitudinal recess and shiftable within the recess.

4. A door handle assembly according to claim 1, wherein the joint having the translational degree of freedom comprises an axis supported on a pivot arm, the pivot arm being pivotally mounted around another axis with respect to the handle support.

5. A door handle assembly according to claim 1, wherein in the flush or retracted position, a Bowden cable transmission, to the door lock is engaging the joint having the translational degree of freedom and urging the joint into a rest position with respect to the translational degree of freedom.

6. A door handle assembly according to claim 1, wherein the movement from the flush or retracted position to the deployed position is defined by rotation about the rotational joints without translation along the translational degree of freedom.

7. A door handle assembly according to claim 1 wherein the assembly comprises a manually operable switch, wherein the switch comprises a switch actuation element, which is hidden and not manually accessible or not operable, when the handle is in the flush or retracted position, and manually operable when the handle is in the deployed or the at least one release position.

8. A door handle assembly according to claim 7, wherein the handle has a handle surface area a) which is, when the handle is in the flush or retracted position, hidden, and not manually accessible, behind or under a surface of a vehicle door surrounding the door handle or behind or under a surface of the handle support, b) and which is manually accessible, and visible, when the handle is in the deployed or the at least one release position, wherein the switch actuation element is positioned on or within this handle surface area.

9. Assembly according to one of claim 1 wherein the assembly has an inertia lock.

10. A door handle assembly according to claim 9, wherein the inertia lock is configured to provide a locking of the door handle preventing a movement of the door handle from the flush or retracted position to the deployed position and configured to provide another locking preventing a movement of the door handle from deployed position to one or more release positions.

11. A door handle assembly according to claim 1, wherein the assembly has at least two release positions of the handle and the arrival of the handle in a first of the release positions triggers an electric signal, wherein the links are forming or are part of a mechanism connecting the handle to the handle support, wherein the mechanism provides the at least two release positions wherein in the first of the release positions an electric switch is switched for electric actuation of the door lock or door lock function and wherein in a second of the release positions another switch is switched or a mechanic actuation of the door lock or a door function is performed.

12. A door handle assembly according to claim 1, wherein the assembly comprises a retaining element configured to define a predetermined threshold of a peak force necessary to bring the handle to the at least one release position, whereby the retaining element is configured to release the handle movement after overcoming the threshold.

13. A door handle assembly according to claim 12, wherein the retaining element is positioned next to a switch, and the retaining element is configured to switch, by its own movement, the switch when a predetermined force lower than the peak force is applied to the handle before overcoming the threshold.

14. A door handle assembly according to claim 13, wherein the retaining element comprises a trough or step, into which one of a pin or an axis or protrusion engages before overcoming the threshold and which the one of the pin or the axis or the protrusion has to overcome by displacing the one of the pin or the axis or the protrusion and/or the retaining element away from each other.

15. A door handle assembly for a vehicle, comprising:

a handle mounted on a handle support and having at least one rest position and at least one release position in which a door lock or a door lock function is a actuated, wherein the door handle assembly has at least three different positions, including:

a flush or retracted position, in which the handle is flush or retracted with respect to an outer door surface, a deployed position, in which the handle protrudes with respect to the outer door surface, and the at least one release position, wherein the handle is connected to the handle support via first and second links, each with corresponding rotational joints at ends thereof, wherein a length between the rotational joints of the first link is substantially the same as a length between the rotational joints of the second link, wherein one of the rotational joints of the first link also has a translational degree of freedom relative to the handle support so that a movement of the first rotational joint along the translational degree of freedom is configured to mechanically actuate the door lock or the door lock function.

16. A door handle assembly according to claim 15, wherein movement of the handle between the flush or retracted position and the deployed position is provided via a drive unit and wherein one of the first and second links is driven by the drive unit and the other of the first and second links is connected to the handle support or to the handle via the one rotational joint.

* * * * *